US008393511B2

(12) United States Patent
Ogawa et al.

(10) Patent No.: US 8,393,511 B2
(45) Date of Patent: Mar. 12, 2013

(54) PNEUMATIC TOOL

(75) Inventors: Tatsushi Ogawa, Tokyo (JP); Kouji Kubo, Tokyo (JP); Takao Tsukada, Tokyo (JP); Norimitsu Sekiguchi, Tokyo (JP); Yoshihiko Kondo, Tokyo (JP); Tomokazu Nagata, Tokyo (JP); Michiaki Adachi, Tokyo (JP); Toshimichi Arai, Tokyo (JP); Hitoshi Tamura, Tokyo (JP); Takeo Fujiyama, Tokyo (JP)

(73) Assignee: Max Co., Ltd., Tokyo (JP)

( * ) Notice: Subject to any disclaimer, the term of this patent is extended or adjusted under 35 U.S.C. 154(b) by 350 days.

(21) Appl. No.: 12/528,493

(22) PCT Filed: Feb. 22, 2008

(86) PCT No.: PCT/JP2008/053101

§ 371 (c)(1),
(2), (4) Date: Aug. 25, 2009

(87) PCT Pub. No.: WO2008/108188

PCT Pub. Date: Sep. 12, 2008

(65) Prior Publication Data

US 2010/0116865 A1 May 13, 2010

(30) Foreign Application Priority Data

Mar. 8, 2007 (JP) ..... 2007-058761
Jun. 4, 2007 (JP) ..... 2007-148199

(51) Int. Cl.
*B25C 1/04* (2006.01)

(52) U.S. Cl. ..... 227/130

(58) Field of Classification Search ..... 173/59, 173/77, 79, 63, 64, 65, 73; 227/130
See application file for complete search history.

(56) References Cited

U.S. PATENT DOCUMENTS

| | | | | |
|---|---|---|---|---|
| 3,961,754 | A * | 6/1976 | Kuhns et al. | 239/289 |
| 5,199,174 | A | 4/1993 | Wild | |
| 5,259,465 | A * | 11/1993 | Mukoyama | 173/168 |
| 5,651,727 | A | 7/1997 | Weinstein et al. | |
| 6,572,000 | B2 * | 6/2003 | Hirai et al. | 227/130 |
| 7,950,557 | B2 | 5/2011 | Fujiyama et al. | |
| 2004/0026477 | A1 * | 2/2004 | Ishizawa et al. | 227/130 |
| 2006/0196910 | A1 * | 9/2006 | Wey | 227/130 |
| 2008/0105729 | A1 * | 5/2008 | Wu et al. | 227/130 |
| 2010/0096428 | A1 | 4/2010 | Fujiyama et al. | |

FOREIGN PATENT DOCUMENTS

| | | |
|---|---|---|
| JP | 10-109280 | 4/1998 |
| JP | 11-179677 | 7/1999 |
| JP | 3385875 | 1/2003 |
| JP | 2004-1135 | 1/2004 |
| JP | 2004-1136 | 1/2004 |
| JP | 2008-142814 | 6/2006 |
| JP | 2008-142815 | 6/2006 |

* cited by examiner

*Primary Examiner* — Brian D Nash
(74) *Attorney, Agent, or Firm* — Drinker Biddle & Reath LLP

(57) ABSTRACT

A pneumatic tool includes a tool body, a nose part for ejecting a nail, which is provided in a lower part of the tool body, an air chamber for storing compressed air, which is provided in the tool body, an air supply pipe for supplying the compressed air from an air supply source to the air chamber, an air duster, an air duster pipeline connected to an air outlet of the air duster, and an air duster valve for controlling supply of the compressed air to the air duster pipeline.

14 Claims, 26 Drawing Sheets

PNEUMATIC TOOL

TECHNICAL FIELD

The present invention relates to a pneumatic tool with an air duster of such a type that the pneumatic tool using compressed air as a drive source, such as a nailing machine, a screw driving machine, a screwing machine, etc. is provided with an air duster for blowing out the compressed air.

BACKGROUND ART

In a flooring work, for example, when a work for driving a nail into furring of floor material is conducted, minute wooden trash sometimes falls on the furring. In case where finishing material is overlaid on the furring in this state to drive another nail, the finishing material may float because of existence of the wooden trash on the furring, and the work must be started again from the beginning. In order to prevent such inconvenience, it has been heretofore accustomed to set the finishing material, after a surface of the furring has been cleaned away with an air duster, and then, conduct the work for driving the nail. However, because the air duster is separately provided from a nailing machine, it has been necessary to frequently exchange the nailing machine with the air duster, which has been extremely annoying.

Under the circumstances, in order to solve the above described inconvenience, a nailing machine provided with an air duster in itself has been known (Reference should be made to Patent Documents 1, 2 and 3). According to such structure, there is no need of exchanging the nailing machine with the air duster at every time.

Patent Document 1: Japanese Patent No. 3385875

Patent Document 2: Japanese Patent Publication No. JP-A-2004-1135

Patent Document 3: Japanese Patent Publication No. JP-A-2004-1136

However, the nailing machine provided with the air duster as described above has the following drawbacks.

(1) Because the compressed air for the air duster is taken out from the same section as an air chamber (an accumulator), oil which has been supplied to a body of the nailing machine is circulated to the air duster together with soil or the like of a hammering mechanism, and discharged. The oil which has been soiled and discharged adheres to the finishing material, and a problem of damaging an object material may occur.

(2) Because the compressed air is directly blown out from the air chamber, a blowing direction of the compressed air is different from a direction of ejecting a fastener. Therefore, when a worker uses the air duster, a direction of the pneumatic tool must be changed, which incurs bad workability. Moreover, in case where an object substance (wooden trash, for example) is small, it is difficult to target it.

(3) When the worker drives a nail into a deep corner at a lower side, he changes his hand to grip the pneumatic tool for convenience, and operates a trigger lever with his little finger, in many cases. On this occasion, the worker sometimes unconsciously presses an operating button of the air duster with his hand. In this case, because the compressed air for the air duster is taken out from the same section as the air chamber, an air pressure inside the air chamber may be lowered, and dust in vicinity of a working site may be scattered, which results in bad workability.

(4) A position where the worker grasps a grip of the pneumatic tool to put a finger on the trigger lever is slightly offset from a position where the worker puts a finger on the operating button. Therefore, when he uses the air duster, he must grasp the grip again to re-start the work, which incurs bad operability.

(5) The pneumatic tool is connected to a compressed air supply source by way of an air hose. Therefore, in case where the pneumatic tool placed on the floor is at a remote position, the pneumatic tool is sometimes drawn near, by pulling the air hose. On this occasion, the pneumatic tool is likely to be caught by a pillar or the like, and the operating button is pressed by the pillar or the like to actuate the air duster, in some cases.

(6) In case where high-pressure air is used, because the ejected air has a high pressure, wooden trash or the like is often blown off more than required. For solving this problem, there has been such a nailing machine that a pressure reducing valve is provided in an air pipeline communicated with a nozzle (Reference should be made to Patent Document 3). However, this nailing machine is heavy, because of increase of components in number, which has been a factor of high cost.

DISCLOSURE OF THE INVENTION

In one or more embodiments of the invention, there is provided a pneumatic tool which has substantially no risk of actuating the pneumatic tool while an air duster is used, can favorably prevent finishing material from being soiled, and can enjoy excellent workability and operability.

According to a first aspect of the invention, a pneumatic tool includes a tool body, a nose part for ejecting a nail, which is provided in a lower part of the tool body, an air chamber for storing compressed air, which is provided in the tool body, an air supply pipe for supplying the compressed air from an air supply source to the air chamber, an air duster, an air duster pipeline connected to an air outlet of the air duster, and an air duster valve for controlling supply of the compressed air to the air duster pipeline.

According to a second aspect of the invention, in the structure of the pneumatic tool in the above described first aspect, one end of the air duster pipeline is branched from the air supply pipe, while the other end of the air duster pipeline is connected to the air outlet of the air duster, and the air duster valve includes a selection operating device for selectively switching over the compressed air supplied from the air supply source to either the air outlet or the air chamber.

According to a third aspect of the invention, in the structure of the pneumatic tool in the above described first aspect, one end of the air duster pipeline is connected to the air chamber, while the other end of the air duster pipeline is connected to the air outlet of the air duster, and the air duster valve includes an opening and closing valve for opening and closing the air duster pipeline.

According to a fourth aspect of the invention, in the structure of the pneumatic tool in the above described first aspect, the air duster pipeline is arranged along a magazine.

According to a fifth aspect of the invention, in the structure of the pneumatic tool in the above described first aspect, the air duster pipeline is arranged along the tool body.

According to a sixth aspect of the invention, in the structure of the pneumatic tool in the above described first aspect, the air outlet is arranged in vicinity of the nose part, and the air is blown out from the air outlet along a direction of ejecting a fastener.

According to a seventh aspect of the invention, in the structure of the pneumatic tool in the above described first aspect, the air duster pipeline is formed of metal.

According to an eighth aspect of the invention, in the structure of the pneumatic tool in the above described first aspect, a filter is provided in a halfway part of the air duster pipeline so as to be exchanged.

According to a ninth aspect of the invention, in the structure of the pneumatic tool in the above described first aspect, the air duster pipeline is arranged by way of a shock absorbing member.

According to a tenth aspect of the invention, in the structure of the pneumatic tool in the above described ninth aspect, the shock absorbing member includes an O-ring.

According to an eleventh aspect of the invention, in the structure of the pneumatic tool in the above described first aspect, a flow controlling mechanism is provided in the air duster pipeline.

According to a twelfth aspect of the invention, in the structure of the pneumatic tool in the above described first aspect, a retractable air jet nozzle is provided inside the air outlet.

According to a thirteenth aspect of the invention, in the structure of the pneumatic tool in the above described first aspect, an operating pipeline is branched from the air chamber, one end of the air duster pipeline is branched from the air supply pipe, while the other end of the air duster pipeline is connected to the air outlet of the air duster, the air duster valve includes a selection valve which is provided in a branch part where the air duster pipeline is branched from the air supply pipe, the operating pipeline is connected to the selection valve by way of an opening and closing valve to be operated by an operating button, and the selection valve has a valve element which is movable between a first position where an upstream side pipeline leading to the air supply source is opened to a downstream side pipeline leading to the air chamber for storing the compressed air and shut off with respect to the air duster pipeline, and a second position where the upstream side pipeline leading to the air supply source is shut off with respect to the downstream side pipeline and opened to the air duster pipeline, wherein when the operating pipeline is closed by the operating button, the valve element is moved to the first position, and when the operating pipeline is opened by the operating button, the valve element is moved to the second position.

According to a fourteenth aspect of the invention, in the structure of the pneumatic tool in the above described thirteenth aspect, the air outlet of the air duster is arranged in vicinity of the nose part, and a direction of blowing out the air from the air duster is substantially the same as the direction of ejecting the fastener by the tool body.

According to a fifteenth aspect of the invention, in the structure of the pneumatic tool in the above described thirteenth aspect, the operating button is disposed on a side face of the tool body, within a reach of a thumb or an index finger of a worker who has gripped the tool body.

According to the first aspect of the invention, the valve element of the selection valve is provided so as to move between the first position where it opens the upstream side pipeline leading to the compressed air supply source to the downstream side pipeline leading to the air chamber for storing the compressed air, and shuts off the branch pipeline for the air duster, and the second position where it shuts off the upstream side pipeline with respect to the downstream side pipeline, and opens to the branch pipeline.

The downstream side pipeline leading to the air chamber is automatically shut off, when the air duster is used. Therefore, there is almost no risk when the air duster is used. Moreover, the air duster is branched from the pipeline before the air is supplied to the air chamber, and hence, lubricating oil supplied to the nailing machine body is not circulated to the air duster together with soil on the hammering mechanism including the air chamber. Therefore, oil or soil will not adhere to a surface of an object material, even though the compressed air is blown to the object material.

According to the second aspect of the invention, the air jet nozzle of the air duster is arranged near an ejecting part, and a direction of blowing out the air from the air duster is substantially the same as the direction of ejecting a fastener by the tool body. Therefore, the worker need not change the direction of the pneumatic tool, when he uses the air duster, and workability is enhanced.

According to the third aspect of the invention, because the operating button is disposed on the side face of the tool body, the worker's hand will not press the operating button of the air duster accidentally, even though the worker changes his hand to grip the pneumatic tool, for convenience's sake, and operates the trigger lever with his little finger, on occasion of driving a nail into a lower corner part. Therefore, dust will not be suddenly scattered, and workability is enhanced.

Moreover, the operating button is arranged within a reach of the thumb or index finger of the worker who has gripped the tool body. Therefore, when the worker uses the air duster by pressing the operating button with the finger, he need not change his hand to grip the pneumatic tool, and operability is enhanced.

Further, when the pneumatic tool is drawn near by pulling the air hose during the work, there is least possibility of pressing the operating button, even though the pneumatic tool is caught by a pillar or the like. Therefore, the air duster is scarcely actuated by mistake.

According to the fourth aspect of the invention, in the pneumatic tool, the air pipeline leading to the air duster is branched from the air supply pipe for supplying the compressed air from the air supply source to the air chamber for storing the compressed air, and the distal end of the air pipeline is connected to the air outlet of the air duster. Further, the selection operating means for selectively switching over the compressed air supplied from the air supply source to the air outlet or the air chamber is provided at an appropriate position. The selection operating means and the air outlet can be respectively provided at the optimum positions on the tool body, the nose part or the grip. As the results, workability and operability of the pneumatic tool can be remarkably enhanced.

Moreover, a length of the air pipeline must be inevitably a length between the position where it is branched from the air supply pipe and the air outlet. However, it would be preferable that the air pipeline is long to some extent, because high pressure of the compressed air is reduced because of pipeline resistance while passing through the air pipeline. When the compressed air is blown out from the air outlet, it has an appropriate pressure to such an extent that wooden trash can be blown off, and therefore, there is no need of providing a particular pressure reducing valve. In addition, the air duster has a simple structure, can be produced at a low cost, and can easily control the flow.

Further, lubricating oil supplied to the nailing machine body is not circulated to the air duster together with soil on the hammering mechanism including the air chamber, and soiled oil will not adhere to a surface of an object material, even though the compressed air is blown to the object material.

According to the fifth aspect of the invention, the operating means for opening and closing the air pipeline which is branched from the air supply pipe and the air outlet can be disposed at the optimum positions on the tool body, the nose part or the grip. For example, the operating means can be arranged within a reach of the thumb or index finger of the worker who has gripped the tool body. In this manner, workability and operability of the pneumatic tool can be remarkably enhanced.

According to the sixth aspect of the invention, because the air pipeline is arranged along the magazine, it is possible to arrange the air pipeline, irrespective of positions of various complicated mechanisms which are provided in the tool body. The air pipeline which is arranged along the magazine is unlikely to be observed, and will not damage an external design of the pneumatic tool.

According to the seventh aspect of the invention, because the air pipeline is arranged along the tool body, it is possible to arrange the air pipeline inside the tool body. In this case, the air pipeline is hardly exposed to the exterior, and hence, the air pipeline will not damage the external design of the pneumatic tool.

According to the eighth aspect of the invention, the air jet nozzle is arranged in vicinity of the nose part, so that the air is blown out from the air outlet along a direction of ejecting the fastener. Therefore, when the worker uses the air duster, the direction of the pneumatic tool need not be changed, and workability is enhanced.

According to the ninth aspect of the invention, because the air pipeline is formed of metal, its rigidity is sufficiently secured. Therefore, the air pipeline will not be broken even with high internal pressure. Moreover, damage or change in shape will be unlikely to occur due to an external force. As the results, the air pipeline is resistant against aging change, and can be easily installed.

According to the tenth aspect of the invention, because the filter is provided in the halfway part of the air pipeline so as to be exchanged, in case where oil or the like is mixed in the compressed air in the air pipeline, it is possible to remove mixed substance and to blow out dry air. In addition, it is possible to exchange the filter, when it is soiled.

According to the eleventh aspect of the invention, because the air pipeline is arranged by way of the shock absorbing member, the air pipeline can be effectively prevented from vibrating to issue strange noise when the compressed air flows, during use of the air duster, and thus, the pneumatic tool can be favorably used.

Moreover, even though the air pipeline is crooked on the halfway, it can be firmly secured.

According to the twelfth aspect of the invention, because the shock absorbing member is formed as the O-ring, it can be easily obtained from a market, without necessity of newly making a mold, and remarkable reduction of cost can be attained.

According to the thirteenth aspect of the invention, the flow controlling mechanism is provided in the air pipeline, and the blowing amount from the air outlet can be controlled. As the results, it will not happen that wooden trash may be blown too far to be scattered or insufficiently swept away.

According to the fourteenth aspect of the invention, the retractable air jet nozzle is provided inside the air outlet. The air jet nozzle may be retracted when the air duster is not used, and pulled out for use to precisely blow out the compressed air to a target position.

Other features and advantages of the invention will be made apparent from description of the embodiments and the attached claims.

Figure 1:
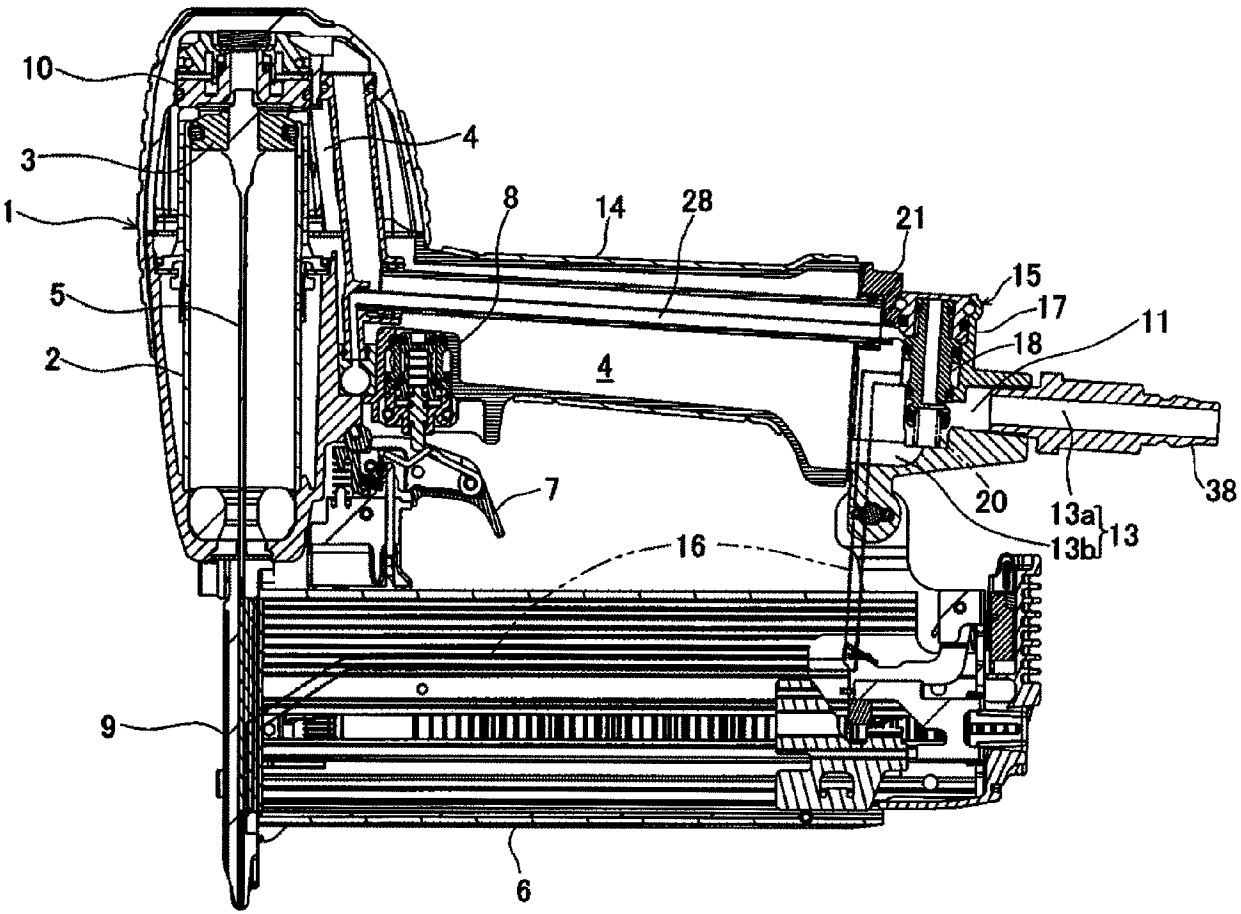
FIG. 1 is a longitudinal sectional view of a nailing machine according to an embodiment of the invention.

DESCRIPTION OF THE REFERENCE NUMERALS AND SIGNS a Air duster
13*a* Upstream side pipeline
13*b* Downstream side pipeline
12 Air duster
15 Selection valve
16 Branch pipeline
18, 48, 64 Valve element
28 Operating pipeline
32 Operating button
101 Tool body
102 Magazine
103 Nose part
106 Air supply pipe
107 Air duster
107*a* Air outlet
108 Air pipeline
117 Operating means

BEST MODE FOR CARRYING OUT THE INVENTION

Now, a nailing machine which is an embodiment of a pneumatic tool according to the invention will be described referring to the drawings. It is to be noted that the pneumatic tool is not limited to the nailing machine. The pneumatic tool may include a screw driving machine, a screwing machine for example, provided that it is operated using a compressed air.

Embodiment 1

A nailing machine body 1 of the nailing machine is provided with a hammering mechanism. The hammering mechanism actuates a hammering piston 3 which is slidably contained in a hammering cylinder 2, using a compressed air stored in an air chamber 4, thereby to eject a nail (a headless nail, a finishing nail, etc.) which is supplied from a magazine 6 into a nose part 9 with a driver 5 which is integrally coupled to the hammering piston 3. Supply of the compressed air into the air chamber 4 is performed by opening action of a main valve 10 in association with a trigger valve 8 which is actuated by operating a trigger lever 7. For enabling the trigger lever 7 to effectively actuate the trigger valve 8, it is necessary to push a distal end 19 of a contact arm (See FIG. 7) against a driven material.

Figure 5:
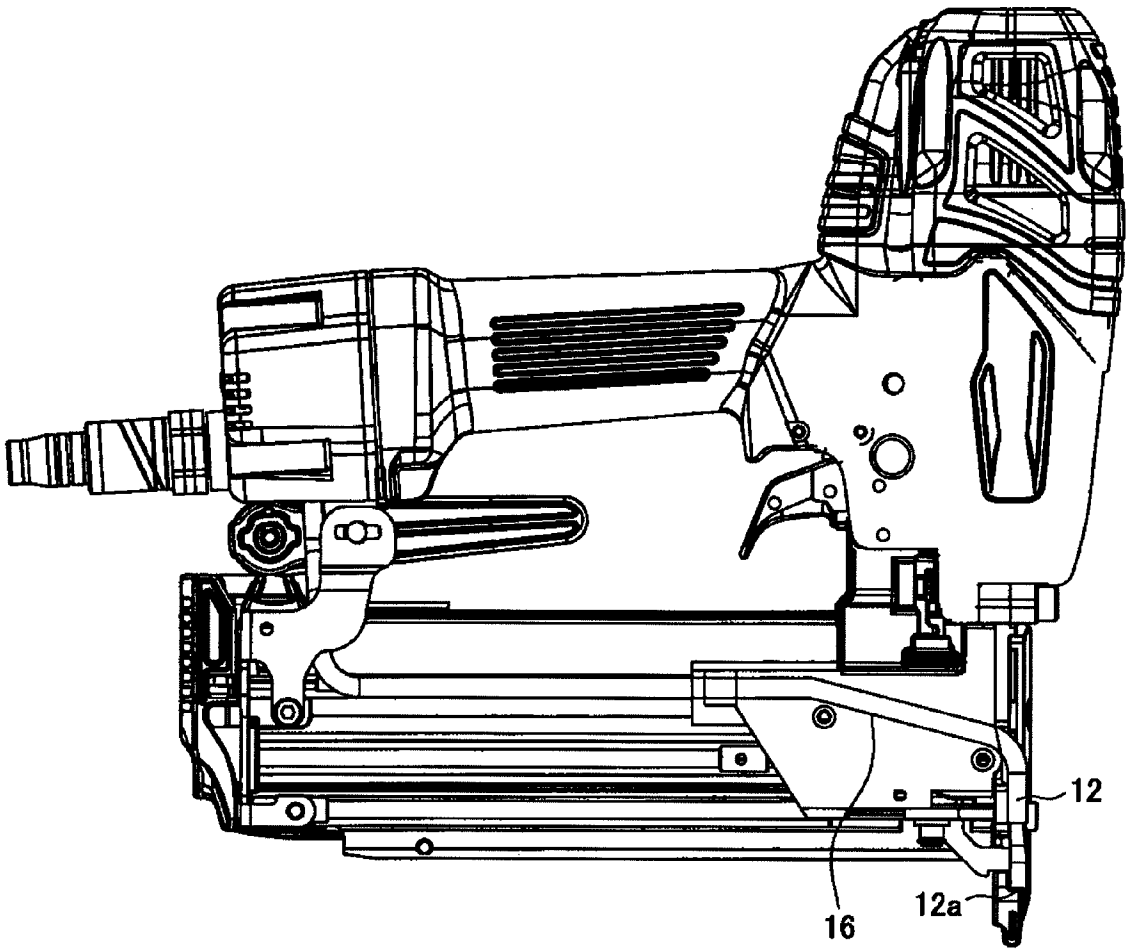
FIG. 5 is a side view of the nailing machine showing a position of an air duster.

Moreover, the nailing machine is provided with an air duster 12 (See FIG. 5). Specifically, the compressed air is taken into the air chamber 4 from an opening 11 at an end of a grip part 14 through an air pipeline 13 (an air supplying passage) which is connected to an air supply source (not shown) such as an air compressor. A pipeline 16 leading to the air duster 12 (an air duster pipeline) is branched in a halfway part of the aforesaid air pipeline 13 by way of a selection valve 15 (an air duster valve).

Figure 3:
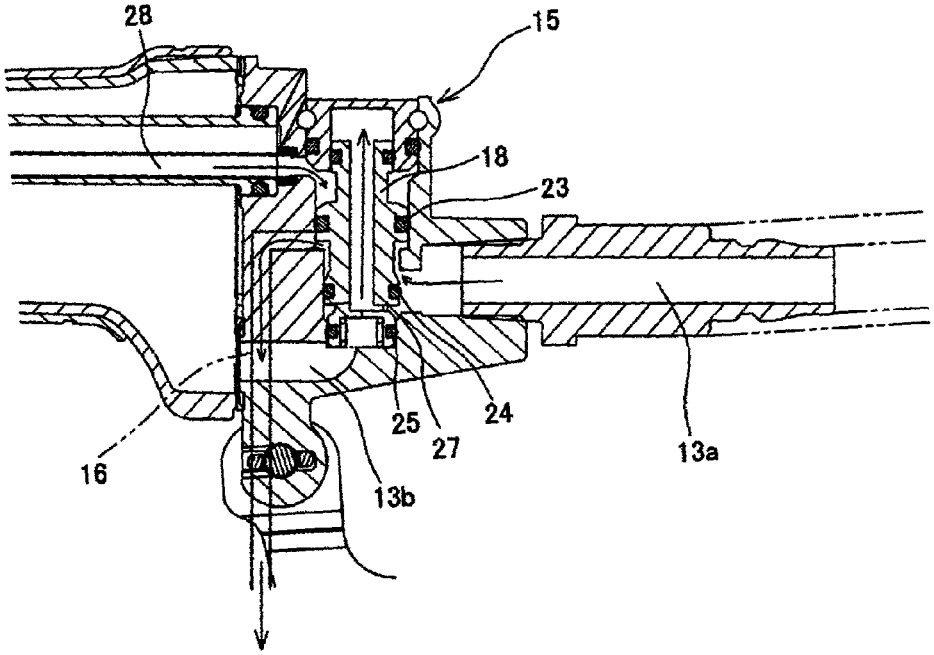
FIG. 3 is an enlarged sectional view showing the selection valve in operation.

The selection valve 15 is disposed in the aforesaid branch part. The selection valve 15 includes a valve element 18 which is provided in a valve housing 17 so as to slide in a vertical direction. The valve element 18 can move between a first position (a position as shown in FIG. 1) where an upstream side pipeline 13*a* leading to the compressed air supply source is opened to a downstream side pipeline 13*b* leading to the air chamber 4 for storing the compressed air and shut off with respect to the branch pipeline 16 for the air duster 12 (the air duster pipeline) and a second position (a position as shown in FIG. 3) where the upstream side pipeline 13*a* is opened to the branch pipeline 16 by shutting off the downstream side pipeline 13*b*. Ordinarily, the valve element 18 is urged by a spring 20 to be positioned at the first position.

The branch pipeline 16 for the air duster (the air duster pipeline) is extended from an end cap 21 of the grip part 14 through a rear part of the magazine 6 and a front part of the magazine 6, along the nose part 9. As shown in FIG. 5, an air jet nozzle 12*a* at a distal end of the branch pipeline 16 is arranged at a slightly upper position than a rear part of a distal end of the nose part 9.

Figure 2:
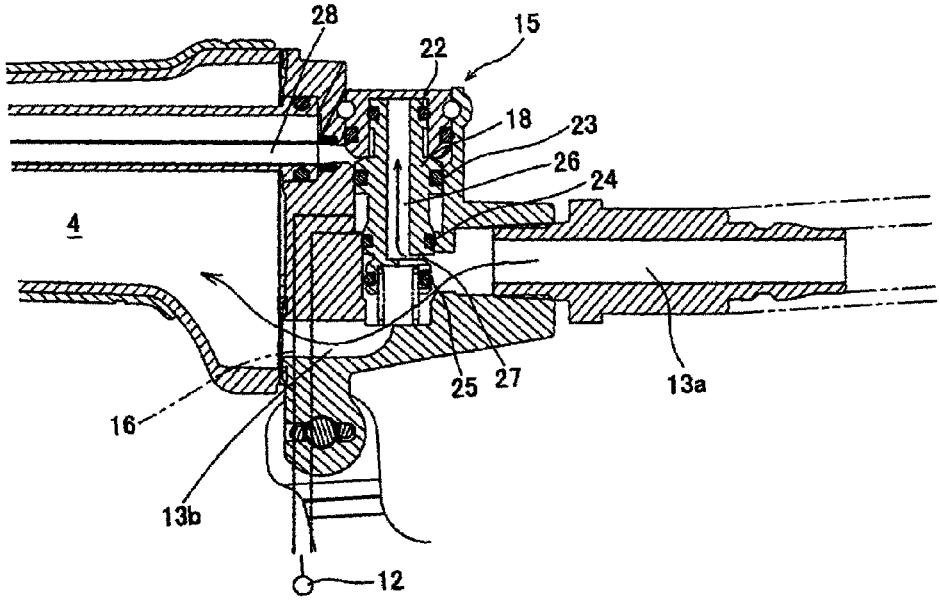
FIG. 2 is an enlarged sectional view showing a selection valve in an initial state.

By the way, as specifically shown in FIG. 2, the valve element 18 of the selection valve 15 is circumferentially provided with a first O-ring 22 having the smallest diameter at its upper end, and a second O-ring 23 having the largest diameter at its intermediate upper part, a third O-ring 24 having an intermediate diameter at its intermediate lower part, and a fourth O-ring 25 at its lower end. Moreover, a center bore 26 is formed at a center of the valve element 18. The center hole 26 is closed between the third O-ring 24 and the fourth O-ring 25, and opens at an upstream side through a through hole 27 formed in a side wall.

Figure 6A:
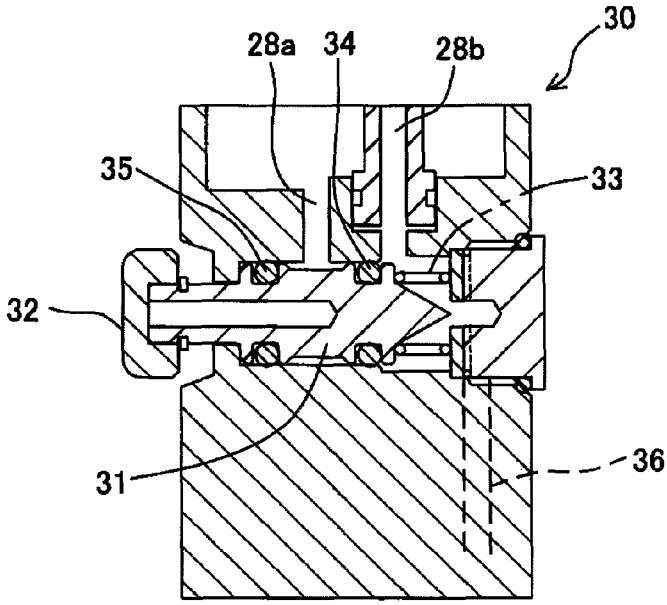
FIG. 6A is a sectional view showing an operation mode of an opening and closing valve.
Figure 6B:
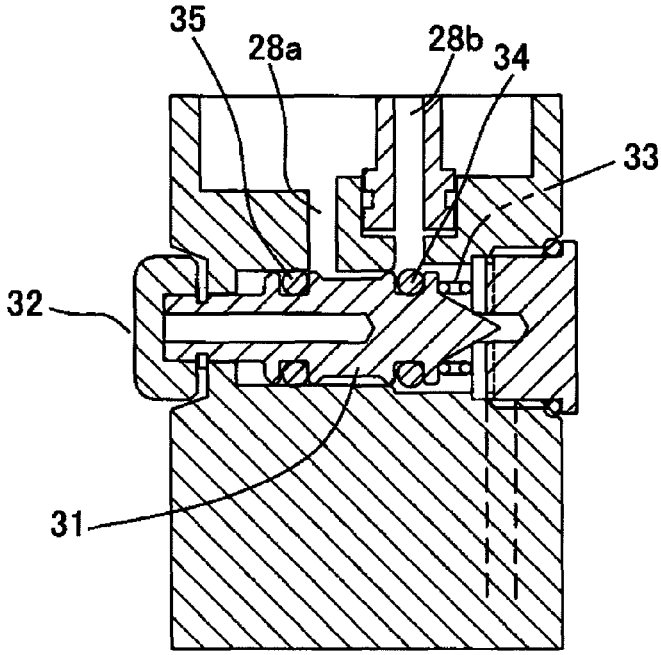
FIG. 6B is a sectional view showing the operation mode of the opening and closing valve.

Further, an operating pipeline 28 is connected to the valve housing 17 of the aforesaid selection valve 15 at a position between the first O-ring 22 and the second O-ring 23. The operating pipeline 28 is branched from the air chamber 4, and provided with an opening and closing valve 30 in a halfway part thereof, as shown in FIG. 6A. The opening and closing valve 30 includes a valve stem 31 which is provided so as to move between a position for closing the operating pipeline 28 (the position in FIG. 6A) and a position for opening the operating pipeline 28 (the position in FIG. 6B), and integrally coupled to an operating button 32 so that opening and closing operation can be conducted from exterior. Ordinarily, as shown in FIG. 6A, the valve stem 31 is urged by a spring 33 so that an O-ring 34 at a distal end side of the valve stem 31 is at a closed position where communication between an upstream side pipeline 28*a* leading to the air chamber 4 and a downstream side pipeline 28*b* leading to the selection valve 15 is shut off. When the valve stem 31 is moved by pressing the operating button 32, as shown in FIG. 6B, the upstream side pipeline 28*a* leading to the air chamber 4 and the downstream side pipeline 28*b* leading to the selection valve 15 are connected to each other through a space between the two O-rings 34 and 35. While the valve stem 31 is at the closed position, the compressed air inside the downstream side operating pipeline 28*b* leaks to the exterior through a discharge pipeline 36.

Figure 7:
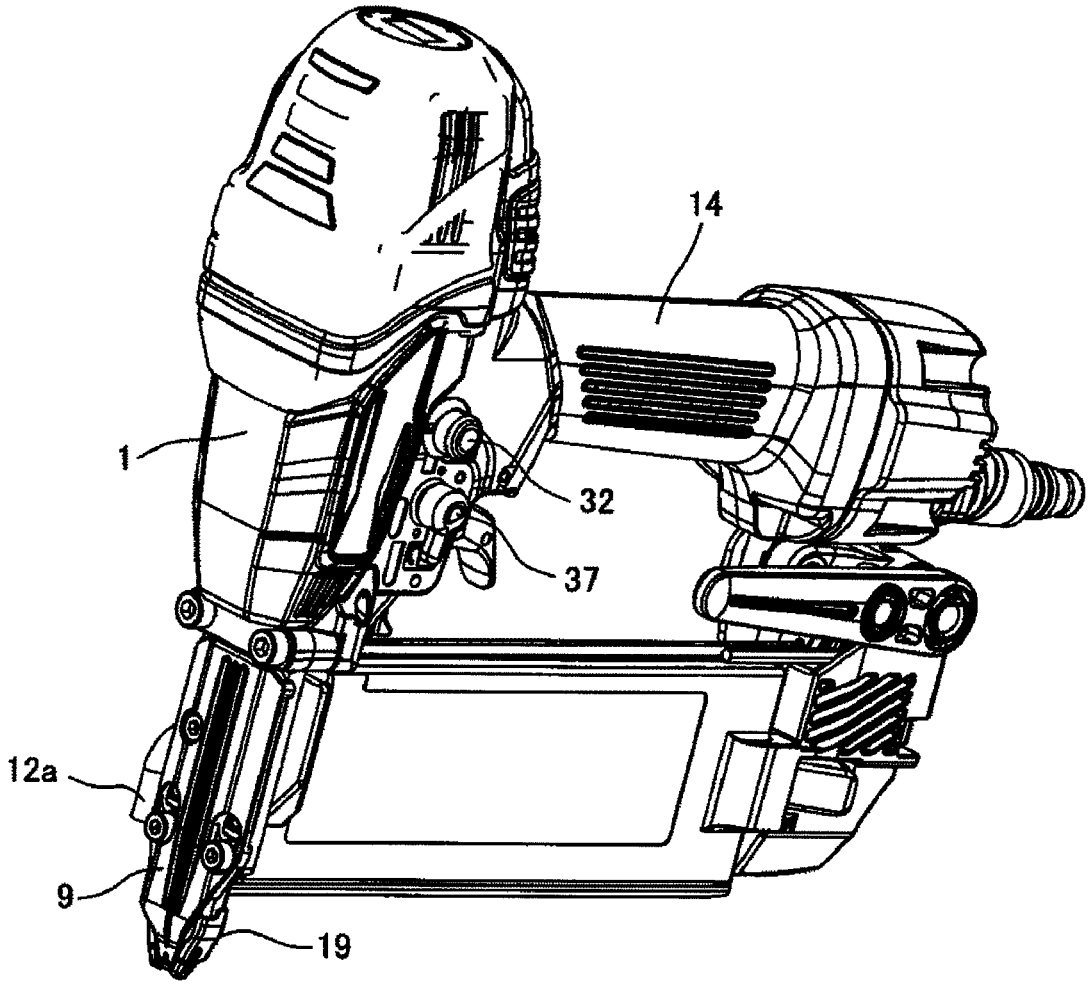
FIG. 7 is a perspective view of the nailing machine showing a position of an operating button for the opening and closing valve.

As shown in FIG. 7, the operating button 32 is disposed on a side face of the tool body 1 at a position above a trigger lock 37. Because the operating button 32 is disposed at this position, a right-handed worker can operate the operating button 32 in this state, by pressing it with his thumb, when he has gripped the grip part 14. In case where the worker is left-handed, he can operate the operating button 32 in this state, by pressing it with his index finger, when he has gripped the grip part 14, without changing his hand to grip the grip part. In this manner, the operating button 32 is preferably disposed within a reach of the thumb or index finger of the worker who has gripped the tool body 1.

Then, operation mode of the nailing machine having the above described structure will be described. When the air duster 12 is not used, the opening and closing valve 30 is kept at the closed position, as shown in FIG. 6A. In this state, the compressed air is not supplied to the operating pipeline 28. Because the compressed air from the compressed air supply source has a larger force in an upward direction due to a difference in diameter between the third O-ring 24 and the first O-ring 22, the selection valve 15 is maintained at the first position as shown in FIGS. 1 and 2. The valve element 18 opens the upstream side pipeline 13*a* leading to the compressed air supply source to the downstream side pipeline 13*b* leading to the air chamber 4 for storing the compressed air, and shuts off the branch pipeline 16 for the air duster 12. Accordingly, the compressed air is continuously supplied to the air chamber 4 from the compressed air supply source, and the hammering mechanism is actuated by pulling operation of the trigger lever 7 and by pushing operation of the contact arm 19, thereby to eject a nail from the nose part 9.

On the other hand, when the air duster 12 is used, the worker presses the operating button 32 with his thumb (or his index finger), while gripping the grip part 14, thereby to move the opening and closing valve 30 to the open position, as shown in FIG. 6B. Then, the compressed air from the air chamber 4 is fed through the operating pipeline 28 into the valve housing 17 of the selection valve 15 at a position between the first O-ring 22 and the second O-ring 23. Accordingly, the air pressure is exerted on the first O-ring 22 and the second O-ring 23. Because the second O-ring 23 is larger in diameter, and the compressed air from the compressed air supply source is exerted on an upper end of the valve element 18 from the through hole 27 in the side wall of the valve element 18 through the center bore 26, the valve element 18 moves to the second position in a lower part, as shown in FIG. 3. As the results, the fourth O-ring 25 shuts off the upstream side pipeline 13*a* leading to the compressed air supply source with respect to the downstream side pipeline 13*b*, and a space between the second O-ring 23 and the third O-ring 24 is opened to the branch pipeline 16. The compressed air is supplied to the branch pipeline 16 and blown out from the air jet nozzle 12*a* at the distal end thereof. Because the air jet nozzle 12*a* is disposed slightly above the rear part of the distal end of the nose part 9, and a direction of the air blown out from the air duster 12 is substantially the same as a direction of ejecting the nail, the worker need not change the direction of the pneumatic tool.

In order to stop the use of the air duster 12, it would be sufficient to detach the finger from the operating button 32. The valve stem 31 is moved by the spring 33 to the position where the operating pipeline 28 is closed, as shown in FIG. 6A, and the downstream side of the operating pipeline 28 leaks to the exterior through the discharge pipeline 36. As the results, the air pressure which is exerted on the second O-ring 23 in a downward direction is reduced, and the valve body 18 moves upward again to return to the position as shown in FIG. 1.

Figure 4A:
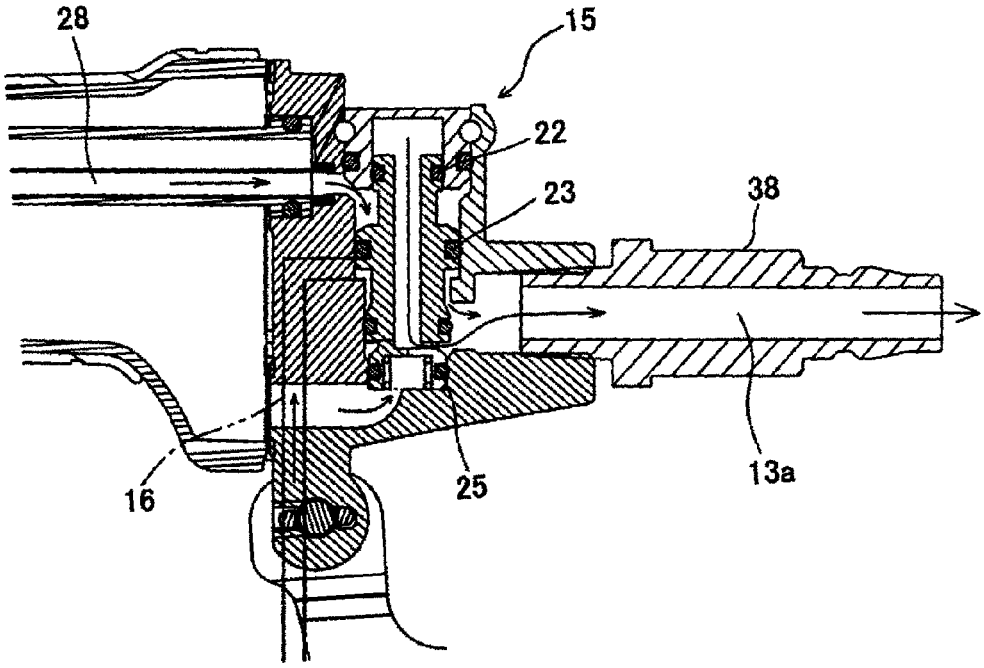
FIG. 4A is a sectional view showing the selection valve before erroneous operation.
Figure 4B:
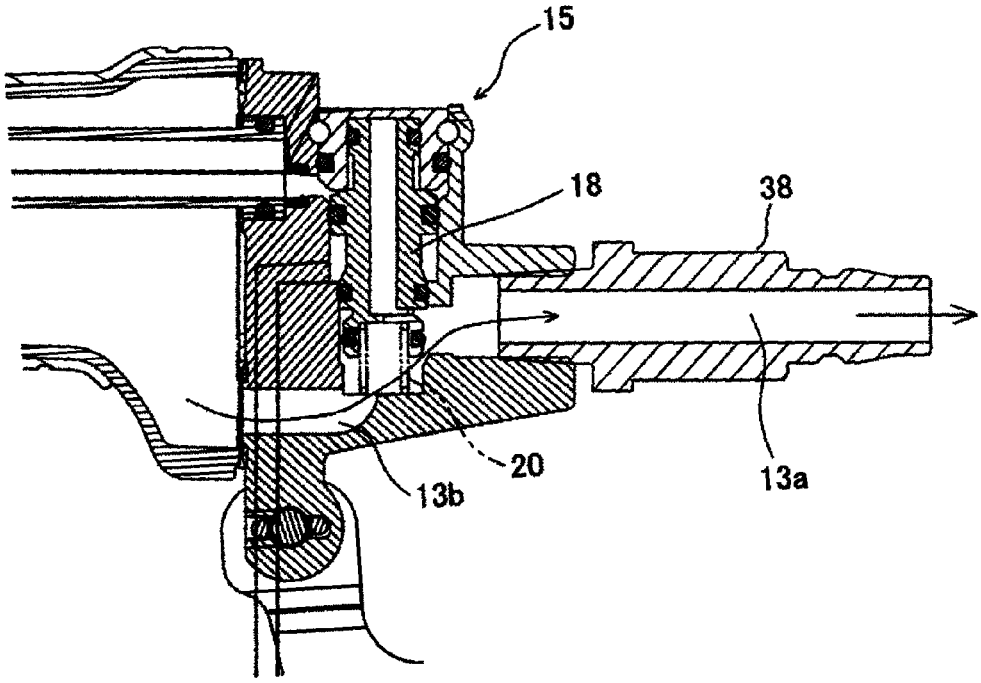
FIG. 4B is a sectional view showing the selection valve after the erroneous operation.

In the state where the operating button 32 of the air duster 12 is pressed, that is, when the selection valve 15 is at the second position in FIG. 3, it sometimes happens that the worker withdraws an air hose leading to the compressed air supply source, by mistake, from an air plug 38 which is provided at a rear end of the grip part 14. In this case, as shown in FIG. 4A, the compressed air is supplied to the sealed space between the first O-ring 22 and the second O-ring 23, while the compressed air in the upstream side pipeline 13*a* of the selection valve 15 is discharged to the atmosphere. Then, the air pressure of the compressed air exerted on the upper end of the valve element 18 is also reduced to the atmospheric pressure, and the air pressure in the branch pipeline 16 for the air duster 12 is also reduced to the atmospheric pressure. For this reason, the air pressure of the compressed air includes an upward pressure P1 which acts on a lower part of the first O-ring 22, a downward pressure P2 which acts on an upper part of the second O-ring 23, and an upward pressure P3 which acts on a lower part of the fourth o-ring 25, and relation "P2−P1<P3+load of the spring 20" is obtained. Accordingly, the valve element 18 moves upward in the same manner as shown in FIG. 4B to return to the first position. As a result, both the compressed air in the air chamber 4 and the compressed air in the operating pipeline 28 are discharged to the atmosphere from the air plug 38, and after all, the compressed air does not remain in the nailing machine body. Therefore, even though the trigger lever 7 is pulled by mistake, the nail will not be ejected by a remaining pressure, and safety is secured.

As described above, the selection valve 15 is provided so as to move between the first position where it opens the upstream side pipeline 13*a* leading to the compressed air supply source to the downstream side pipeline 13*b* leading to the air chamber 4 for storing the compressed air and shuts off the upstream side pipeline 13*a* with respect to the branch pipeline 16 for the air duster 12, and the second position where it opens the upstream side pipeline 13*a* to the branch pipeline 16 and shuts off the upstream side pipeline 13*a* with respect to the downstream side pipeline 13*b*. Accordingly, the downstream side pipeline 13*b* leading to the air chamber 4 is automatically shut off, when the air duster is used. Therefore, there is almost no risk at a time of using the air duster.

Moreover, the air jet nozzle 12*a* of the air duster 12 is arranged in vicinity of an ejecting part, and a direction of blowing out the air from the air duster 12 is substantially the same as the direction of ejecting a fastener. Therefore, the worker need not change the direction of the pneumatic tool, when he uses the air duster 12, and workability is enhanced.

Further, because the operating button 32 is disposed on the side face of the tool body 1, the worker's hand will not press the operating button 32 of the air duster 12 accidentally, even though the worker changes his hand to grip the pneumatic tool, for convenience's sake, and operates the trigger lever 7 with his little finger, on occasion of driving a nail into a lower corner part. Therefore, dust will not be suddenly scattered, and workability is enhanced.

Further, the operating button 32 is positioned within a reach of the thumb or index finger of the worker who has gripped the tool body 1. Therefore, when the worker uses the air duster 12 by pressing the operating button 32 with the finger, he need not change his hand to grip the pneumatic tool 1, and operability is enhanced.

Still further, when the pneumatic tool is drawn near by pulling the air hose, there is least possibility of pressing the operating button 32, even though the pneumatic tool is caught by a pillar or the like. Therefore, it hardly happens that the air duster 12 is actuated by mistake.

Figure 8A:
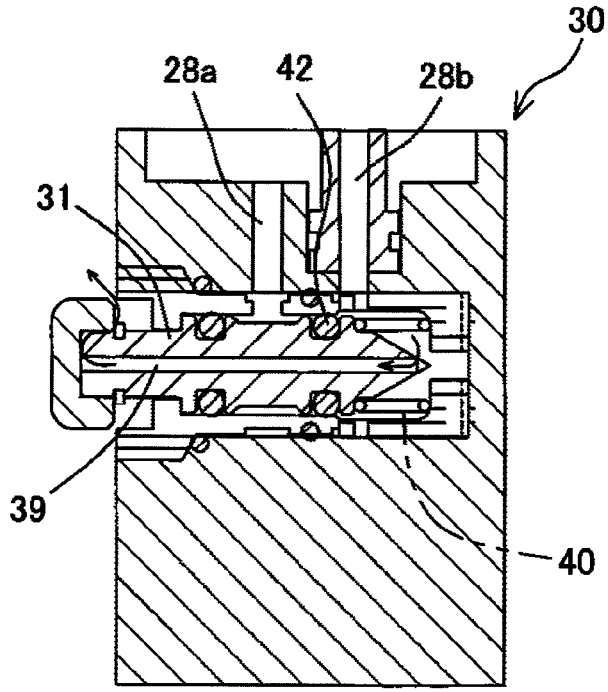
FIG. 8A is a sectional view showing an operation mode of another opening and closing valve.
Figure 8B:
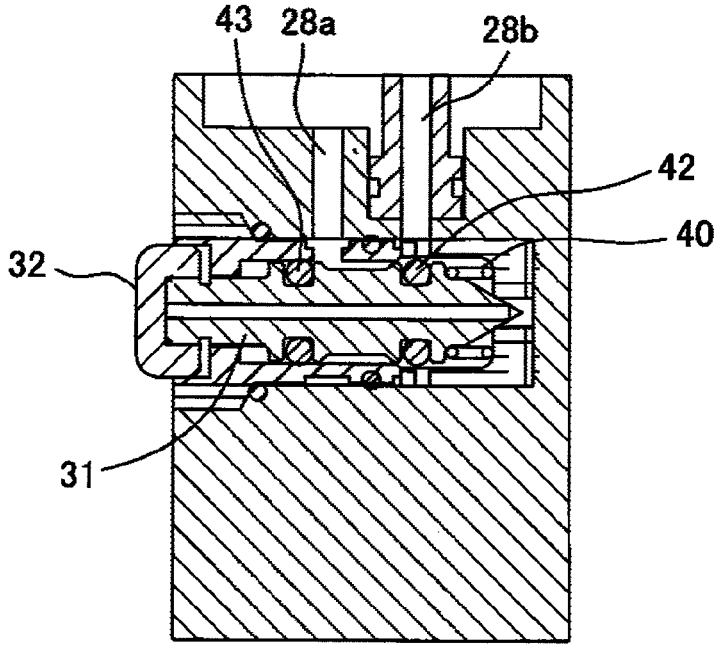
FIG. 8B is a sectional view showing the operation mode of the other opening and closing valve.

Moreover, the structure of the opening and closing valve is not limited to the one as described above. For example, in the opening and closing valve 30 as shown in FIG. 8A, an O-ring 42 at a distal end side of the valve stem 31 is ordinarily urged by a spring 40 to the closed position where communication between the operating pipeline 28*a* at the upstream side leading to the air chamber 4 and the operating pipeline 28*b* at the downstream side leading to the selection valve 15 is shut off. When the valve stem 31 is moved by pressing the operating button 32 as shown in FIG. 8B, a space S between the two O-rings 42, 43 interconnects the operating pipeline 28*a* at the upstream side leading to the air chamber 4 and the operating pipeline 28*b* at the downstream side leading to the selection valve 15. When the valve stem 31 is at the closed position, the compressed air in the operating pipeline 28 at the downstream side passes through a center through hole 39 of the valve stem 31, as shown by an arrow mark, to leak to the exterior from a position near the operating button 32.

Figure 9A:
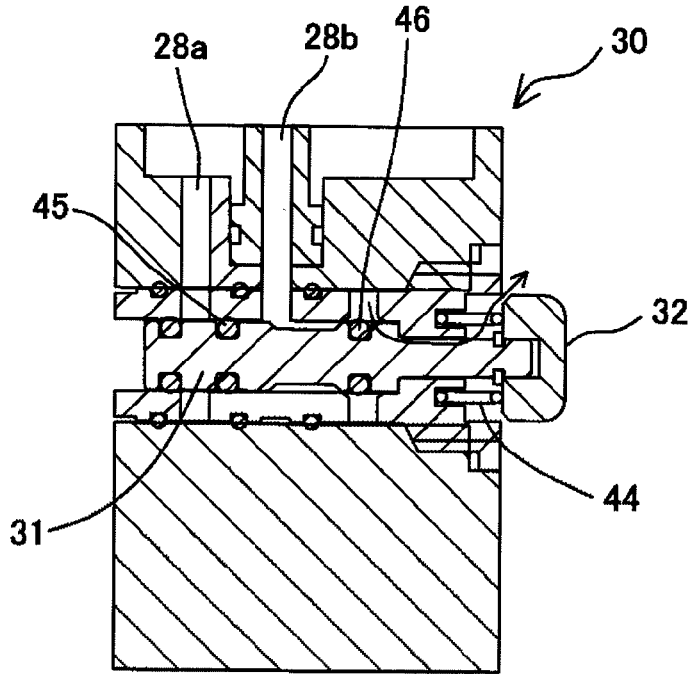
FIG. 9A is a sectional view showing an operation mode of still another opening and closing valve.
Figure 9B:
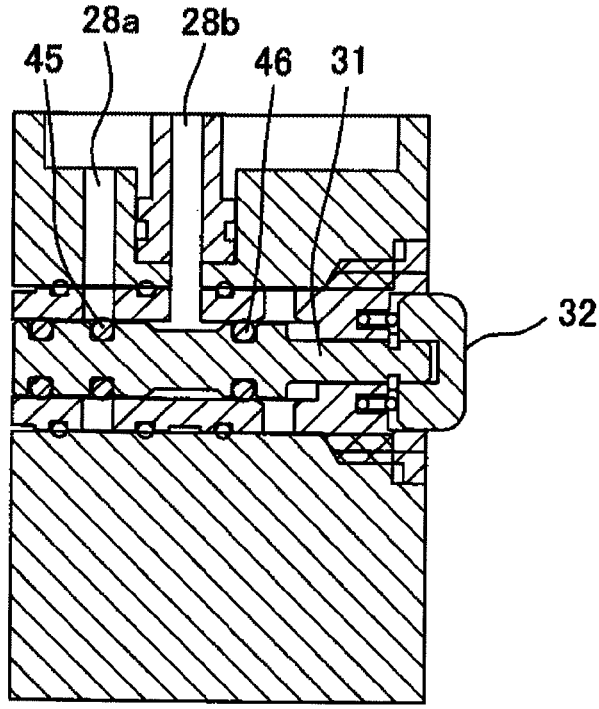
FIG. 9B is a sectional view showing the operation mode of the still another opening and closing valve.

Moreover, in the opening and closing valve 30 as shown in FIGS. 9A, 9B, two O-rings 45, 46 at a distal end side and at an intermediate of the valve stem 31 are ordinarily urged by a spring 44 to a closed position where communication between the operating pipeline 28*a* at the upstream side leading to the air chamber 4 and the operating pipeline 28*b* at the downstream side leading to the selection valve 15 is shut off, as shown in FIG. 9A. When the valve stem 31 is moved by pressing the operating button 32 as shown in FIG. 9B, a space between the two O-rings 45, 46 at the distal end side and at a base side interconnects the operating pipeline 28*a* at the upstream side leading to the air chamber 4 and the operating pipeline 28*b* at the downstream side leading to the selection valve 15. When the valve stem 31 is at the closed position, the operating pipeline 28*b* at the downstream side is communicated with the atmosphere through a gap along a periphery of the valve stem 31 and an inner wall of the valve housing, as shown by an arrow mark, thereby to leak the air to the exterior from a position near the operating button 32.

Figure 10:
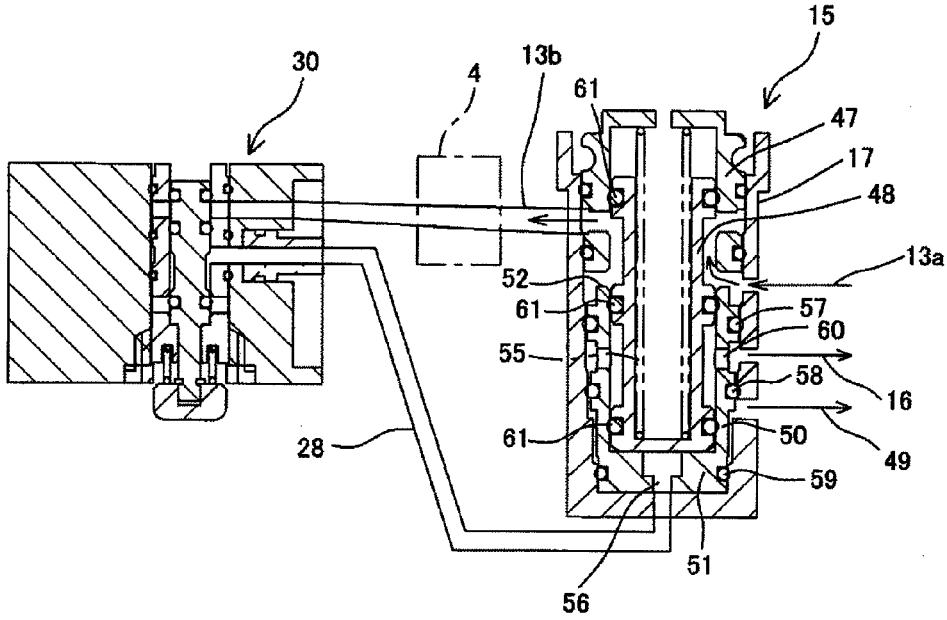
FIG. 10 is a sectional view showing a selection valve in another embodiment.

Then, FIG. 10 shows another embodiment of the selection valve. The same reference numbers as those shown in FIG. 9A represent the same members. The selection valve 15 includes a valve sleeve 47 in a bottomed tubular shape which is fixed at one side in the valve housing 17, a relief valve 50 having the same diameter as the valve sleeve 47 which is slidably contained at the other side, and a valve element 48 in a bottomed tubular shape which is contained in both the valve sleeve 47 and the relief valve 50 so as to freely slide. The upstream side pipeline 13*a* leading to the compressed air supply source, the downstream side pipeline 13*b* leading to the air chamber 4, the branch pipeline 16 leading to the air duster 12, an exhaust pipeline 49, and the operating pipeline 28 leading to the opening and closing valve 30 are respectively formed so as to open into the valve housing 17.

Figure 11:
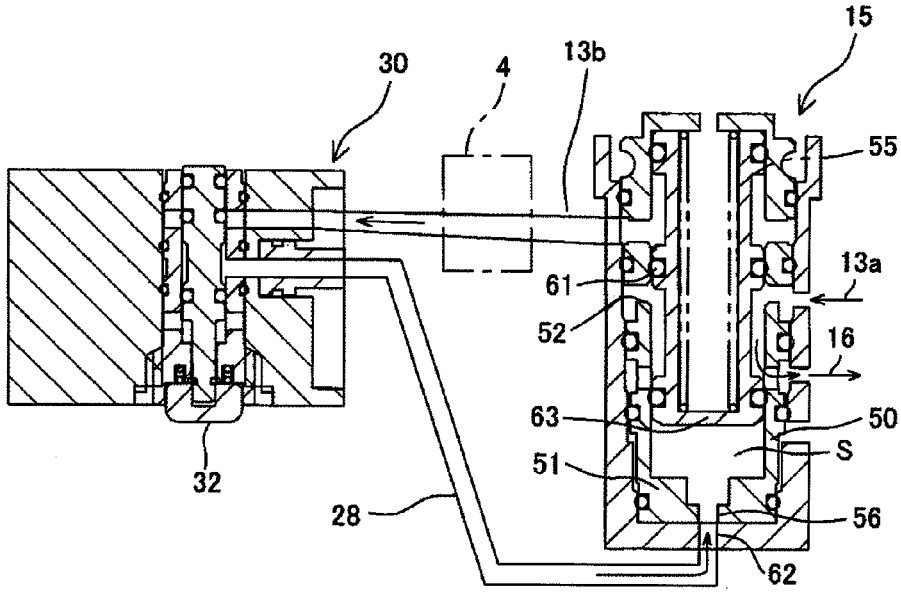
FIG. 11 is a sectional view showing an operation mode of the selection valve in the above described embodiment.
Figure 12:
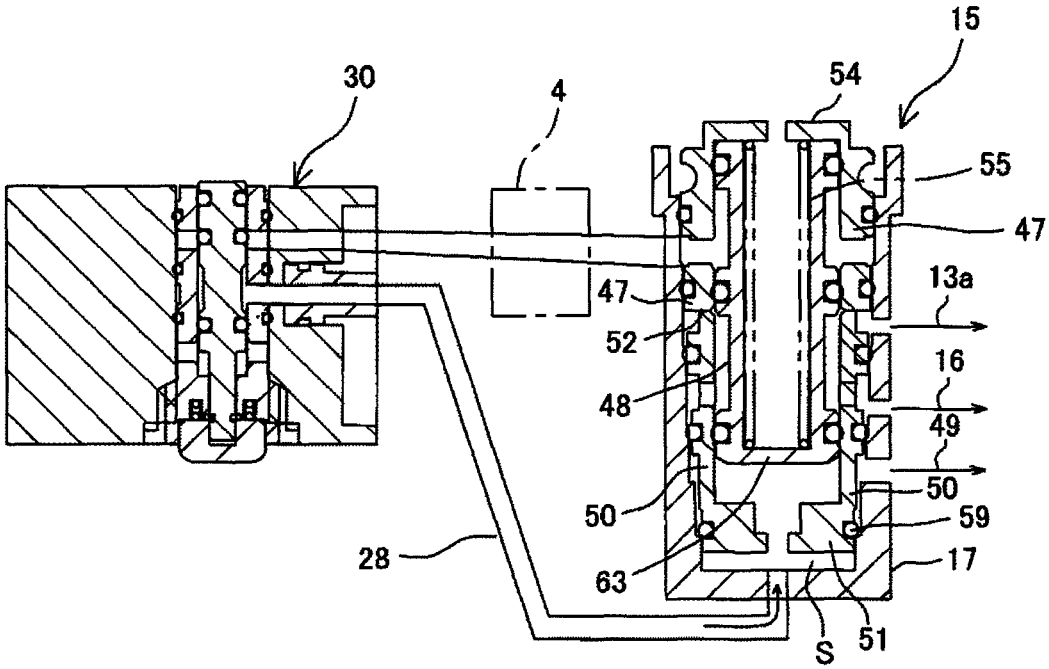
FIG. 12 is a sectional view showing an operation mode of the selection valve in the above described embodiment, at a time of erroneous operation.

The relief valve 50 slides between a lower position where its lower bottom part 51 is engaged with an end of the valve housing 17 (the position as shown in FIGS. 10 and 11) and an upper position where its open end 52 at the opposite side is engaged with the valve sleeve 47 (the position as shown in FIG. 12). The valve element 18 slides within a range between a first position where it is engaged with the lower bottom part 51 of the relief valve 50 (the position as shown in FIG. 10) and a second position where its open end 52 is engaged with an upper bottom part 54 of the valve sleeve 47 (the position as shown in FIGS. 11 and 12). The valve sleeve 47 and the valve element 48 are additionally urged by a spring 55 toward the lower bottom part 51. It is to be noted that the relief valve 50 is operated only for preventing accidental ejection.

An opening 56 is formed at a center of the lower bottom part 51 of the relief valve 50. Moreover, three O-rings 57, 58, 59 respectively having a large diameter, a middle diameter, and a small diameter are circumferentially formed on an outer peripheral face of the relief valve 50, and a through hole 60 is formed between the two O-rings 57 and 58 respectively having the large diameter and the middle diameter. Further, the valve element 48 is provided with three O-rings 61 having the same diameter at a substantially equal interval on an outer peripheral face thereof.

In addition, the opening and closing valve 30 (the same as shown in FIGS. 9A and 9B, in this embodiment) is provided between the air chamber 4 and the selection valve 15.

In the above described structure, when the air duster 12 is not used, the relief valve 50 and the valve element 48 are kept at the lower position by the spring 55 (the valve element 48 is at the first position), as shown in FIG. 10. At the first position, the upstream side pipeline 13*a* leading to the compressed air supply source is opened to the downstream side pipeline 13*b* leading to the air chamber 4 for storing the compressed air, shutting off the branch pipeline 16 for the air duster 12. Accordingly, the compressed air from the compressed air supply source is continuously supplied to the air chamber 4, whereby the hammering mechanism is actuated with pulling operation of the trigger lever 7 and pushing operation of the contact arm, and the nail is ejected from the nose part 9.

On the other hand, when the air duster 12 is used, the opening and closing valve 30 is moved to the open position by pressing the operating button 32, as shown in FIG. 11. Then, the compressed air from the air chamber 4 is supplied by way of the operating pipeline 28, from an opening 62 at the end of the selection valve 15 through the opening 56 in the lower bottom part 51 of the relief valve 50, to a space S between the respective lower bottom parts 51 and 63 of the relief valve 50 and the valve element 48. Due to this air pressure, the valve element 48 is moved against the spring 55 to the second position at the opposite side. As the results, the intermediate O-ring 61 shuts off the upstream side pipeline 13*a* leading to the compressed air supply source with respect to the downstream side pipeline 13*b*, and opens the upstream side pipeline 13*a* to the branch pipeline 16. Accordingly, the compressed air is supplied to the branch pipeline 16, and blown out from the air jet nozzle 12*a* at the distal end.

Although the pressure of the compressed air is exerted on an outer face of the lower bottom part 51 of the relief valve 50 too, the compressed air is also exerted on the open end 52 at the same time. Because a pressure receiving area of the lower bottom part 51 is smaller than that of the open end 52, the relief valve 50 will not move.

In order to stop the use of the air duster 12, it would be sufficient to detach the finger from the operating button 32. The compressed air in the operating pipeline 28 at the downstream side of the opening and closing valve 30 is leaked to the exterior through a gap at a side of the operating button. As the results, the air pressure exerted on the valve element 48 is reduced, and the valve element 48 moves upward again to return to the first position in FIG. 10.

In case where the worker has withdrawn the air hose leading to the compressed air supply source, by mistake, from the air plug 38, in the state where the operating button 32 of the air duster 12 is pressed, that is, while the selection valve 15 is at the second position, the compressed air in the upstream side pipeline 13*a* of the selection valve 15 and the compressed air in the branch pipeline 16 to the air duster 12 are discharged to the atmosphere, as shown in FIG. 11. As the results, the air pressure which has been exerted on the relief valve 50 and the open side of the valve element 48 is reduced to the atmospheric pressure. On the other hand, the compressed air still remains in the downstream side pipeline 13*b* and the operating pipeline 28. The compressed air in the operating pipeline 28 is supplied to a space S between the valve housing 17 and the lower bottom part 51 of the relief valve 50, as shown in FIG. 12, and due to this air pressure, the relief valve 50 is moved upward. Consequently, the O-ring 59 of the relief valve 50 having the small diameter is disengaged from the valve housing 17, and thus, the compressed air in the operating pipeline 28 and the compressed air in the air chamber 4 are exhausted through the exhaust pipeline 49. Because both the compressed air in the operating pipeline 28 and the compressed air in the air chamber 4 are discharged to the atmosphere from the air plug 38, there remains no compressed air in the nailing machine body, after all. Therefore, even though the trigger lever 7 is pulled by mistake, the nail will not be ejected by remaining pressure, and safety is secured.

Figure 13:
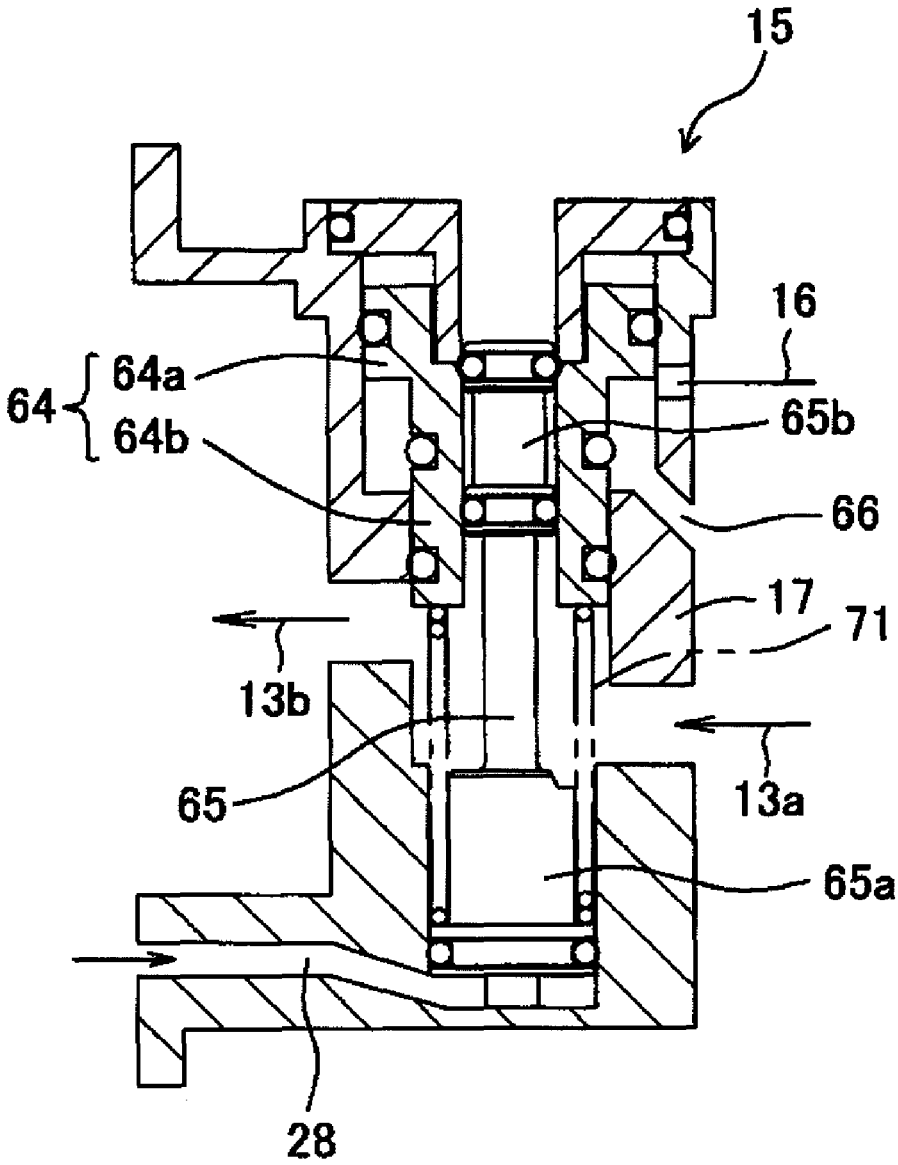
FIG. 13 is a sectional view showing a selection valve in still another embodiment.

Then, FIG. 13 shows another embodiment of the selection valve 15. The same reference numbers as those shown in FIG. 12 represent the same members. The selection valve 15 includes a valve element 64 in a tubular shape and a relief piston 65 which are slidably disposed in the valve housing 17 in series, and a part of the relief piston 65 is contained in the valve element 64 so as to slide. The upstream side pipeline 13*a* leading to the compressed air supply source, the downstream side pipeline 13*b* leading to the air chamber 4, the branch pipeline 16 leading to the air duster 12, an air vent hole 66, and the operating pipeline 28 leading to the opening and closing valve 30 are respectively open into the valve housing 17.

The valve element 64 includes a large diameter part 64*a* and a small diameter part 64*b*, and the relief piston 65 also includes a large diameter part 65*a* and a small diameter part 65*b*. Moreover, the large diameter part 65*a* of the relief piston 65 and the small diameter part 64*b* of the valve element 64 are so formed as to be engaged with each other, and further, a spring 71 is disposed between them.

Figure 15:
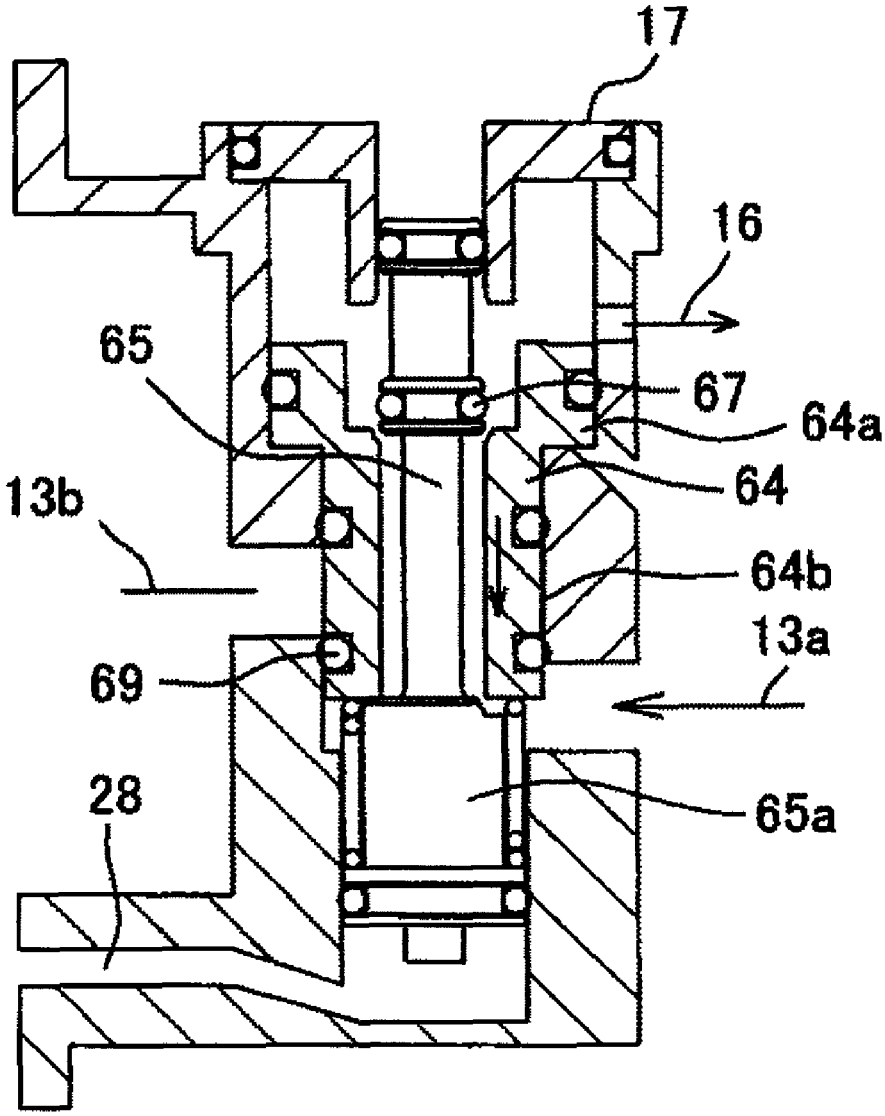
FIG. 15 is a sectional view showing the operation mode of the selection valve in the above described embodiment.

The valve element 64 is so arranged as to slide between a first position where it opens the upstream side pipeline 13*a* leading to the compressed air supply source to the downstream side pipeline 13*b* leading to the air chamber 4, and shuts off the upstream side pipeline 13*a* with respect to the branch pipeline 16 for the air duster 12 (the position in FIG. 13) and a second position where it shuts off the upstream side pipeline 13*a* with respect to the downstream side pipeline 13*b*, and opens the upstream side pipeline 13*a* to the branch pipeline 16 (the position in FIG. 15).

In addition, the opening and closing valve 30 as described above is provided between the air chamber 4 and the selection valve 15.

In the above described structure, when the air duster 12 is not used, the relief piston 65 and the valve element 64 are kept at the opposite positions to each other by the spring 71 (the valve element 64 is at the first position). At the first position, the compressed air from the compressed air supply source is continuously supplied to the air chamber 4, whereby the hammering mechanism is actuated with pulling operation of the trigger lever 7 and pushing operation of the contact arm, and the nail is ejected from the nose part 9.

Figure 14:
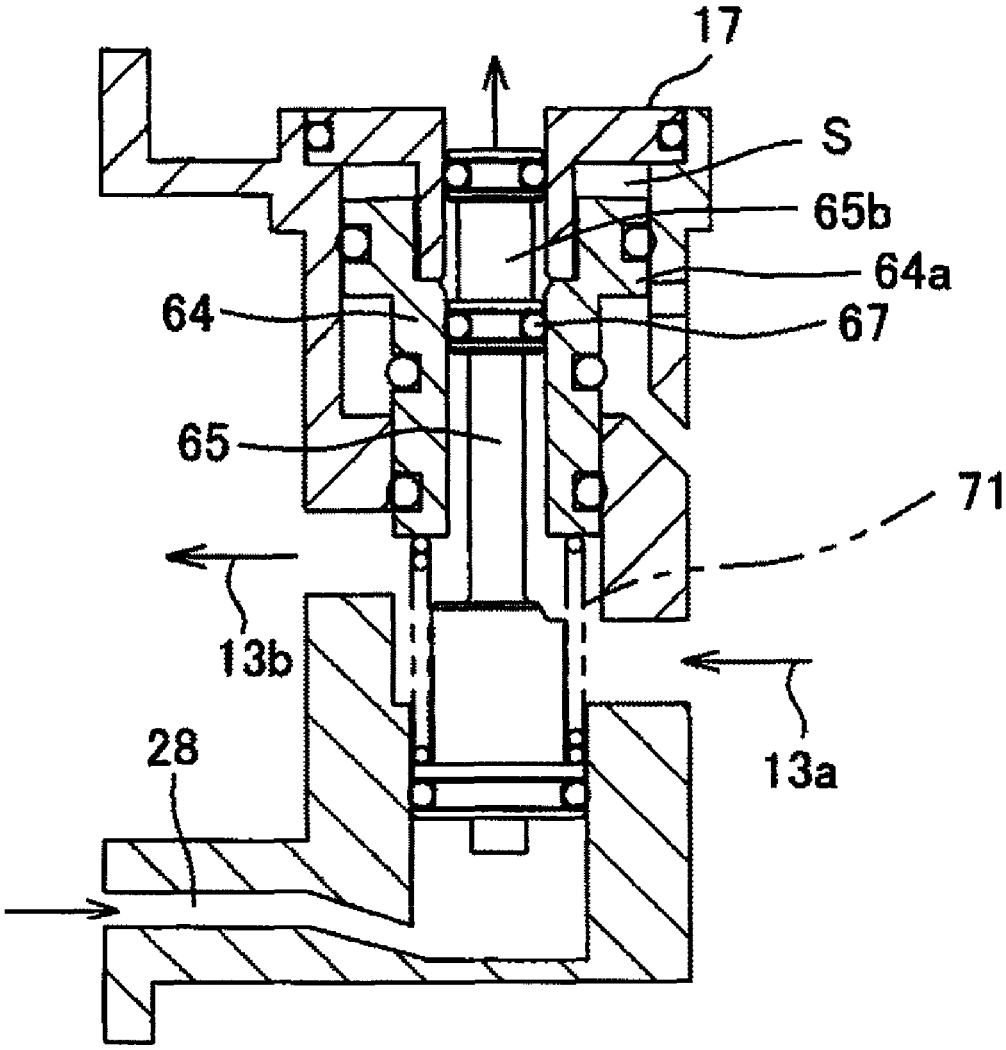
FIG. 14 is a sectional view showing the selection valve in the above described embodiment in operation.

On the other hand, when the air duster 12 is used, the opening and closing valve 30 is operated to open by pressing the operating button 32. Then, the compressed air is supplied to the operating pipeline 28 at the downstream side, and further, fed to the selection valve 15. As a result, the relief piston 65 moves toward the small diameter part 65*b* against the spring 71, as shown in FIG. 14. Accordingly, an O-ring 67 of the small diameter part 65*b* is further moved beyond the position in FIG. 14, and disengaged from the small diameter part 64*b* of the valve element 64. Therefore, the compressed air is supplied to a space S between the large diameter part 64*a* of the valve element 64 and a bottom of the valve housing 17 thereby to move the valve element 64 to the second position as shown in FIG. 15. As a result, an O-ring 69 of the small diameter part 64*b* shuts off the upstream side pipeline 13*a* leading to the compressed air supply source with respect to the downstream side pipeline 13*b*, and the upstream side pipeline 13*a* is opened to the branch pipeline 16. Accordingly, the compressed air is supplied to the branch pipeline 16, and blown out from the air jet nozzle 12*a* at the distal end.

While the valve element 64 moves to the second position, the valve element 64 is brought into contact with the large diameter part 65*a* of the relief piston 65 thereby to slightly push back the relief piston 65 to the initial position. The relief piston 65 is stabilized when the valve element 64 has moved to the second position.

When the use of the air duster 12 is stopped, by releasing the finger from the operating button 32, the air in the operating pipeline 28 at the downstream side of the opening and closing valve 30 is leaked to the exterior. As the results, the air pressure exerted on the valve element 64 is reduced, and the valve element 64 moves upward again to return to the first position in FIG. 13.

Figure 16:
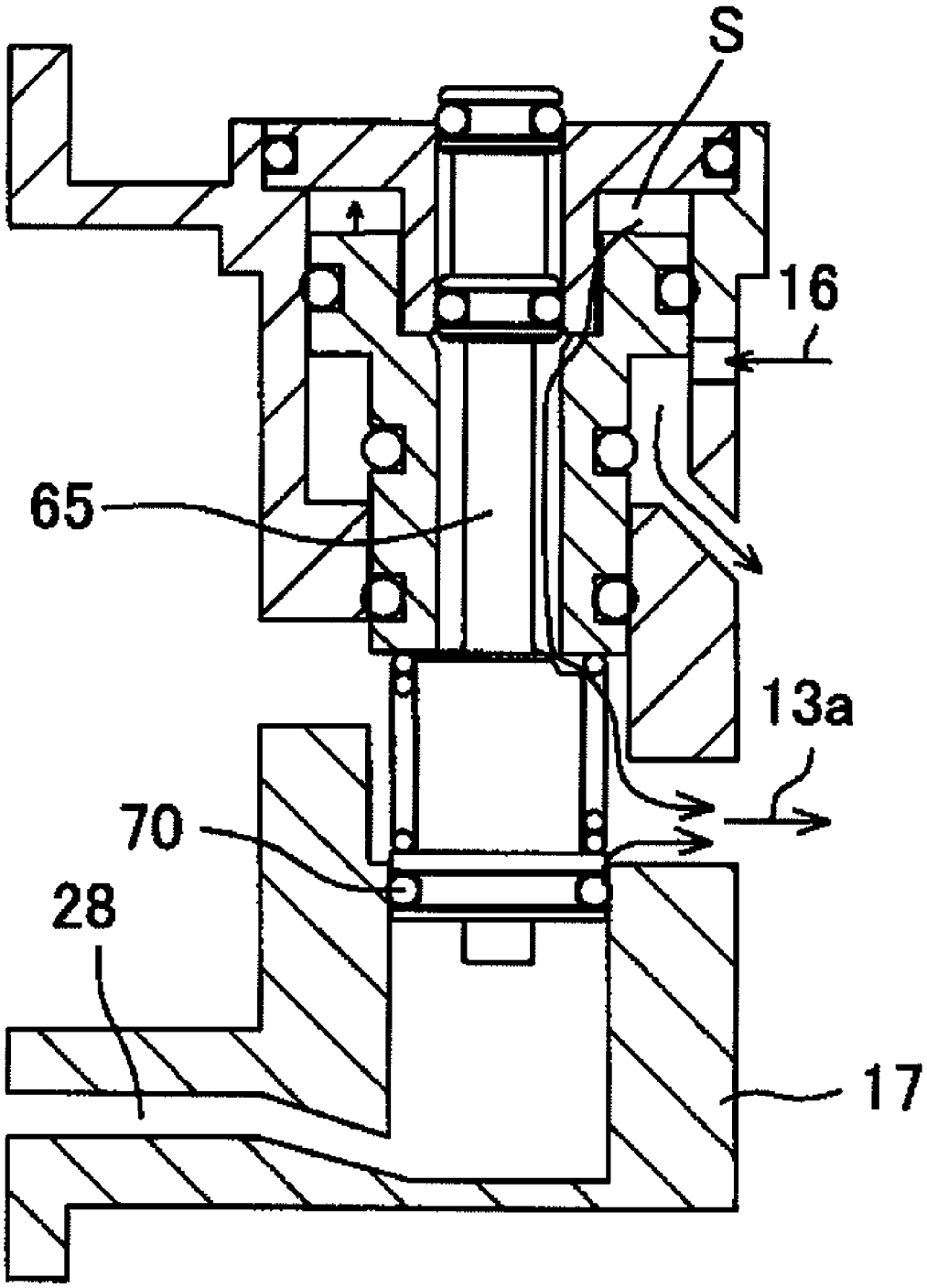
FIG. 16 is a sectional view showing an operation mode of the selection valve in the above described embodiment, at a time of abnormal operation.
Figure 17:
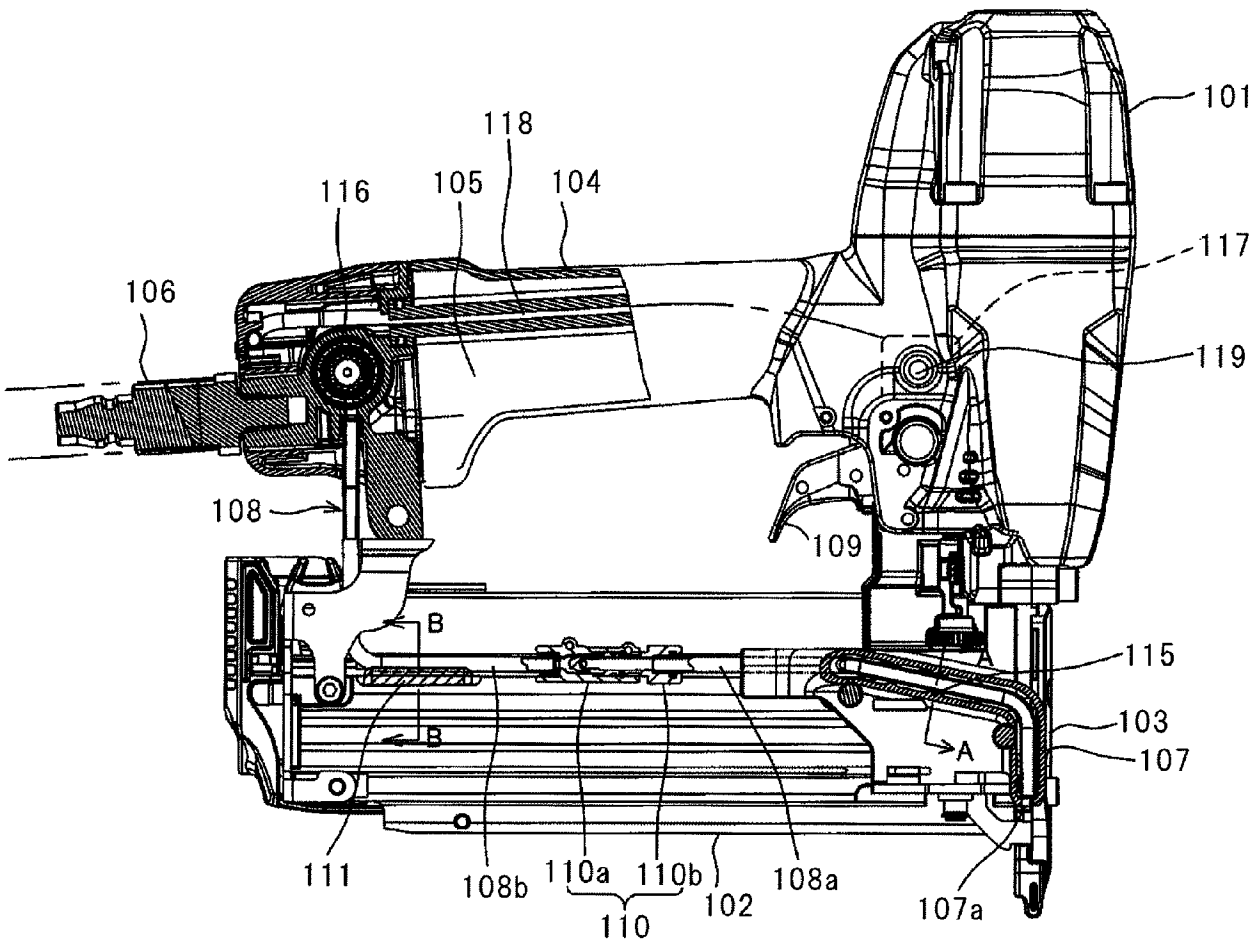
FIG. 17 is a side view of a nailing machine according to the invention showing a part of the nailing machine in section.

In case where the worker has withdrawn the air hose leading to the compressed air supply source, by mistake, from the air plug 38, in the state where the operating button 32 of the air duster 12 is pressed, that is, while the selection valve 15 is at the second position in FIG. 15, the compressed air in the upstream side pipeline 13*a* upstream of the valve element 64 and the compressed air in the aforesaid space S are discharged to the atmosphere, as shown in FIG. 16. On the other hand, the compressed air remains in the operating pipeline 28 at the downstream side, and hence, the relief piston 65 moves to the first position of the valve element 64, in a state engaged with the valve element 64. Accordingly, the compressed air in the branch pipeline 16 is also discharged to the atmosphere. As the results, an O-ring 70 at the end of the relief piston 65 is disengaged from a sliding part of the valve housing 17, and the compressed air in the selection valve 15 and the compressed air in the air chamber 4 are discharged to the atmosphere from the air plug. Therefore, there remains no compressed air in the nailing machine body, and hence, even though the trigger lever 7 is pulled by mistake, the nail will not be ejected by remaining pressure, and safety is secured.

Embodiment 2

A tool body 101 of the nailing machine is provided with a hammering mechanism. Although not shown in the drawings, the hammering mechanism is so constructed that a hammering piston slidably contained in a hammering cylinder which is provided in the tool body 101 is actuated using a compressed air stored in an air chamber, thereby to eject a nail (a headless nail, finishing nail, etc.) which is supplied from a magazine 102 into a nose part 103 with a driver which is integrally coupled to the hammering piston. The hammering mechanism is actuated by operating a trigger lever 109.

The air chamber is an internal air room for storing the compressed air, which is mainly formed around the hammering cylinder, and continued to an air room 105 which is formed inside a grip 104 provided in a rear part of the tool body 101. An essential structure of the hammering mechanism of the tool body 101 has been known.

The compressed air is taken into the air chamber from an opening at a rear end of the grip 104 through an air supply pipe 106 which is connected to an air supply source (not shown) such as an air compressor. An air pipeline 108 (an air duster pipeline) leading to an air duster 107 is branched from the air supply pipe 106.

A distal end of the air pipeline 108 is connected to an air outlet 107*a* of the air duster 107 which will be described below, and the compressed air in the air supply pipe 106 flows through the air pipeline 108 by way of selection operating means (a selection operating device as an air duster valve) to be blown out from the air outlet 107*a*.

The air outlet 107*a* can be provided at an optimum position suitable for blowing off wooden trash or the like. Because the nail is driven to a position where the wooden trash has been swept away, the air outlet 107*a* is preferably arranged near the position of ejecting the nail, so that the compressed air may be blown out along the direction of ejecting the nail. The air outlet 107*a* is preferably arranged along the nose part 103, as shown in the drawing, and directed downward so that the compressed air may be blown out in parallel with the direction of ejecting the nail or in an extension of the direction of ejecting the nail.

The air pipeline 108 which is branched from the air pipeline 106 is suspended from the rear end part of the grip 104 to the rear end part of the magazine 102, and further extended in a longitudinal direction of the magazine 102, to be connected to the air outlet 107*a* in a front part of the magazine 102.

The air pipeline 108 is preferably formed of metal. Moreover, a front part 108*a* and a rear part 108*b* of the air pipe line 108 may be connected by a connecting member 110 including an outer tube body 110*a* and an inner tube body 110*b* which is screwed into the outer tube body 110*a*. In this case, an inner diameter of the outer tube body 110*a* may be made larger than a diameter of an end part of the inner tube body 110*b* to be screwed in, so that the larger a screwing amount of the inner tube body 110*b* is made, the smaller a flowing amount of the compressed air becomes. This connecting member 110 may be used as a flow controlling mechanism for controlling the flowing amount of the compressed air by adjusting the screwing amount.

Figure 18A:
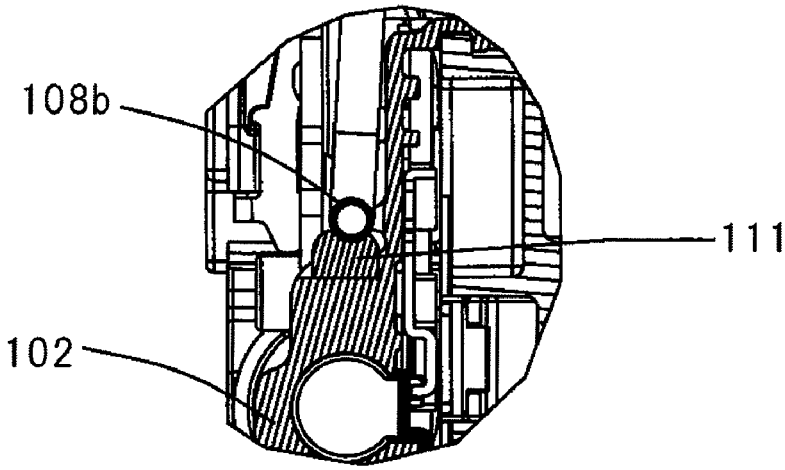
FIG. 18A is an enlarged sectional view taken along a line B-B in FIG. 17.
Figure 18B:
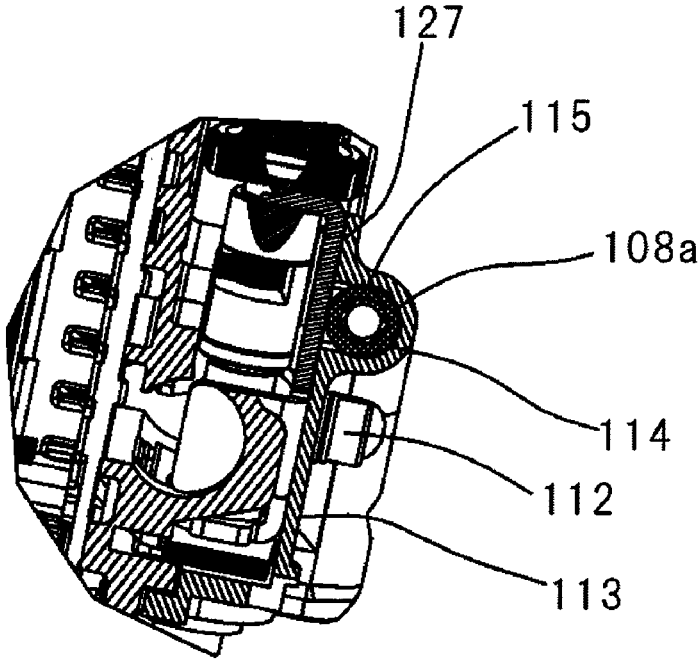
FIG. 18B is an enlarged sectional view taken along a line A-A in FIG. 17.

Moreover, the air pipeline 108 is mounted to the magazine 102 by way of a shock absorbing member (elastic material 111, an O-ring 115). Specifically, as shown in FIG. 18A, the rear air pipeline 108*b* is arranged above the magazine 102, and supported by the magazine 102 by way of the elastic material 111. As shown in FIG. 18B, the front air pipeline 108*a* is positioned inside a support member 113 which is fixed to a side face of a front part of the magazine 102 with a bolt 112. A concave groove 114 is formed inside the support member 113, and a plurality of O-rings 115 are wound around the air pipeline 108*a*. The air pipeline 108*a* is in contact with an inner face of the concave groove 114 and a side face of a cover 127 by way of the O-rings 115.

The selection operating means includes a selection valve 116 (selecting means) and operating means 117 for operating the selection valve 116. The selection valve 116 is provided at a branch part between the air supply pipeline 106 and the air pipeline 108. Although not shown, the selection valve 116 is so formed as to selectively supply the compressed air which is supplied from the air supply pipe 106 to either of the aforesaid air chamber and the air pipeline 108 for the air duster 107. The operating means 117 operates the selection valve 116 which is provided between the air chamber and the air supply pipe 106 to be opened or closed, by means of an operating button 119, thereby to supply the compressed air in the air chamber to the selection valve 116 to control the selecting operation. By pressing the operating button 119, an opening and closing valve which is ordinarily urged in a closing direction is operated to open, and the compressed air in the air chamber is fed to the selection valve 116 through a control pipe 118, thereby to actuate the air pipeline 108 in an opening direction (the air chamber is closed). Further, by blowing out the compressed air from the air outlet 107*a* of the air duster 107, and releasing the operating button 119, the control pipe 118 is closed thereby to actuate the air pipeline 108 in a closing direction (the air chamber is opened). In this manner, the blow of the compressed air from the air outlet 107*a* of the air duster 107 is stopped.

In the above described structure, when the air duster 107 is used, the air outlet 107*a* is directed to a target position, and the operating button 119 of the selection operating means is pressed, thereby to actuate the selection valve 116 so as to open the air pipeline 108. In this manner, the compressed air is blown out from the air outlet 107*a* to blow off wooden trash or the like. After the use, the finger is detached from the operating button 119 thereby to actuate the selection valve 116 so as to close the air pipeline 108 again.

As described above, according to the pneumatic tool having the above described structure, it is possible to provide the selection operating means for selecting either of the air supply pipe 106 and the branched air pipeline 108, and the air outlet 107*a* at the optimum positions on the tool body 101, the nose part 103 or the grip 104. As the results, workability and operability of the nailing machine can be remarkably enhanced.

Moreover, a length of the air pipeline 108 must be inevitably a length between the position where it is branched from the air supply pipe 106 and the air outlet 107*a*. However, it would be preferable that the air pipeline 108 is long to some extent, because high pressure of the compressed air is reduced because of pipeline resistance while passing through the air pipeline 108. When the compressed air is blown out from the air outlet 107*a*, it has an appropriate pressure to such an extent that the wooden trash can be blown off, and therefore, there is no need of providing a particular pressure reducing valve. In this manner, the air duster 107 has a simple structure, and can be produced at a low cost.

Further, lubricating oil supplied to the tool body 101 is not circulated to the air duster 107 together with soil on the hammering mechanism including the air chamber, and soiled oil will not adhere to a surface of an object material, even though the compressed air is blown to the object material.

The air pipeline 108 can be arranged irrespective of positions of various complicated mechanisms which are provided in the tool body 101, because it is arranged along the magazine 102. Therefore, the air pipeline 108 which is arranged along the magazine 102 is unlikely to be observed, and will not damage an external design of the pneumatic tool.

Further, the operating means 117 for the air pipeline 108 which is branched from the air supply pipe 106 and the air outlet 107*a* can be respectively disposed at the optimum positions on the tool body 101, the nose part 103 or the grip 104. For example, the operating button 119 can be arranged within a reach of the thumb or index finger of the worker who has gripped the tool body 101. Because the operating button 119 is disposed at this position, a right-handed worker can operate the operating button 119 in this state, by pressing it with his thumb, when he has gripped the grip 104, without changing his hand to grip it. In case where the worker is left-handed, he can operate the operating button 119 in this state, by pressing it with his index finger, when he has gripped the grip 104, without changing his hand to grip it. In this manner, workability and operability of the pneumatic tool can be remarkably enhanced.

In this connection, the air jet nozzle is arranged in vicinity of the nose part 103, so that the air is blown out from the air outlet 107*a* along the direction of ejecting the fastener. Therefore, when the worker uses the air duster 107, he need not change the direction of the pneumatic tool, and workability is enhanced.

Further, because the air pipeline 108 is formed of metal, its rigidity is sufficiently secured. Moreover, because the flow controlling mechanism is provided in the air pipeline 108, and the blowing amount of the air from the air outlet 107*a* can be controlled, such anxiety that wooden trash may be blown too far to be scattered or insufficiently swept away is eliminated.

Additionally, because the air pipeline 108 is arranged by way of the shock absorbing members 111, 115, the air pipeline 108 can be effectively prevented from vibrating to issue strange noise when the compressed air flows, during use of the air duster 107, and thus, the pneumatic tool can be favorably used. Moreover, even though the air pipeline 108 is crooked on the halfway, it can be firmly secured. In case where the shock absorbing member is formed as the O-ring 115, it can be easily obtained from a market, without necessity of newly making a mold, and remarkable reduction of cost can be attained.

The structure of the air duster 107 is not limited to the one in the above described embodiment.

Figure 19:
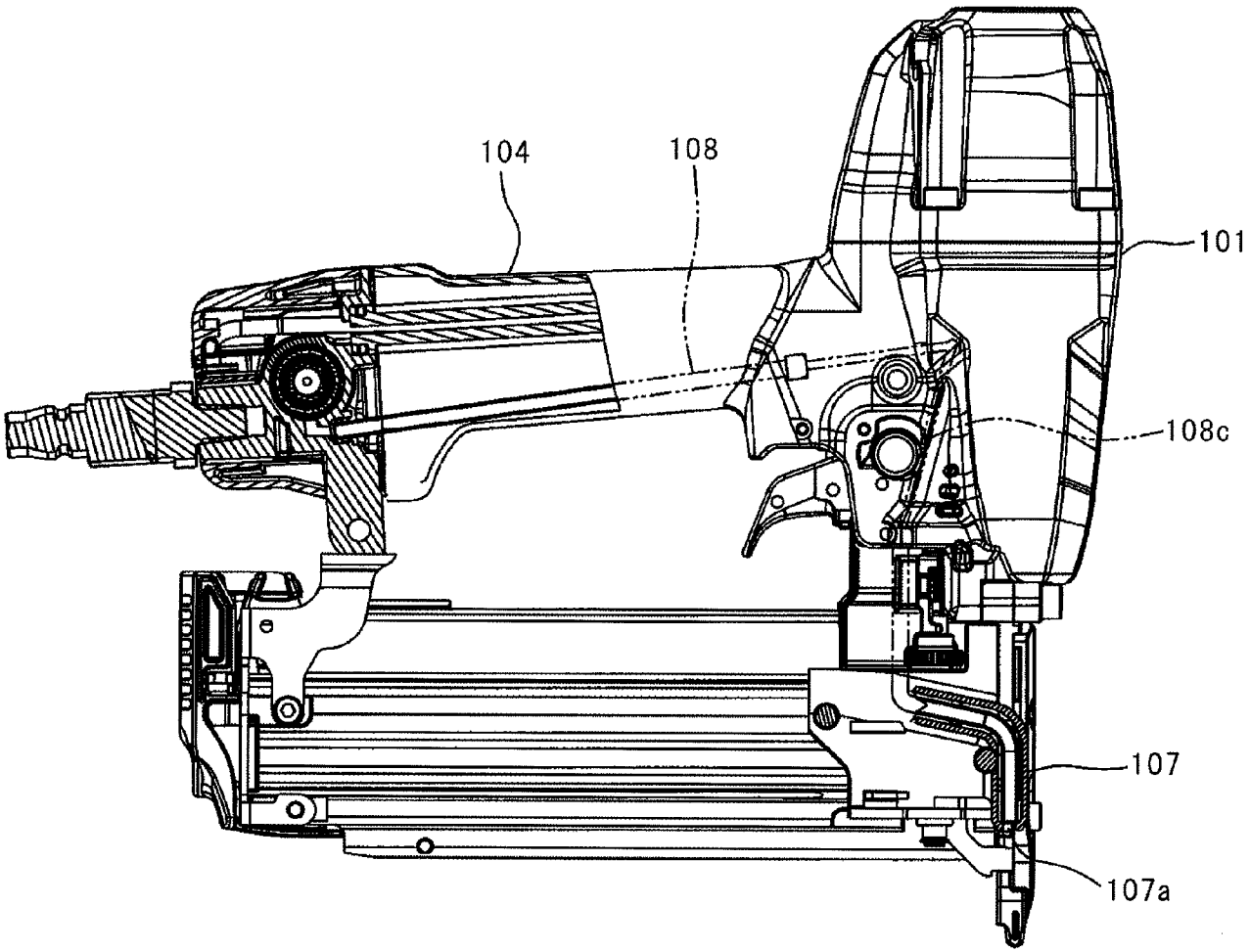
FIG. 19 is a side view of a nailing machine in still another embodiment showing an air pipeline partly in section.

For example, the air pipeline 108 may be continuously arranged so as to extend from the grip 104 along the tool body 101, as shown in FIG. 19. In this case, because the air pipeline 108 can be arranged inside the grip 104 and the tool body 101, the air pipeline 108 is hardly exposed to the exterior. Therefore, the air pipeline 108 will not damage the external design of the pneumatic tool. Moreover, a part 108*c* of the air pipeline 108 may be formed to have a small diameter, as shown in FIG. 19.

Figure 20:
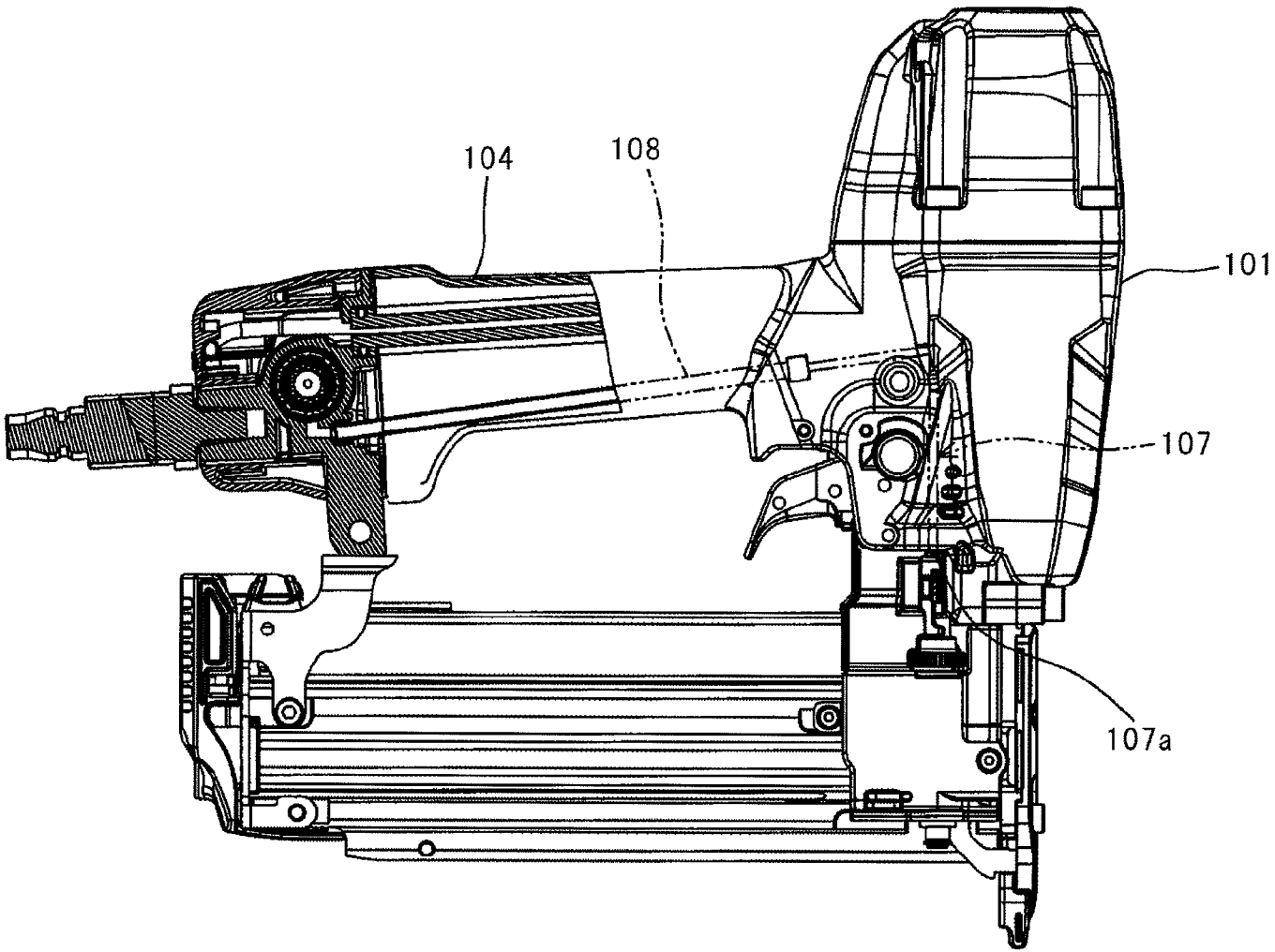
FIG. 20 is a side view of a nailing machine in still another embodiment showing an air outlet partly in section.
Figure 21:
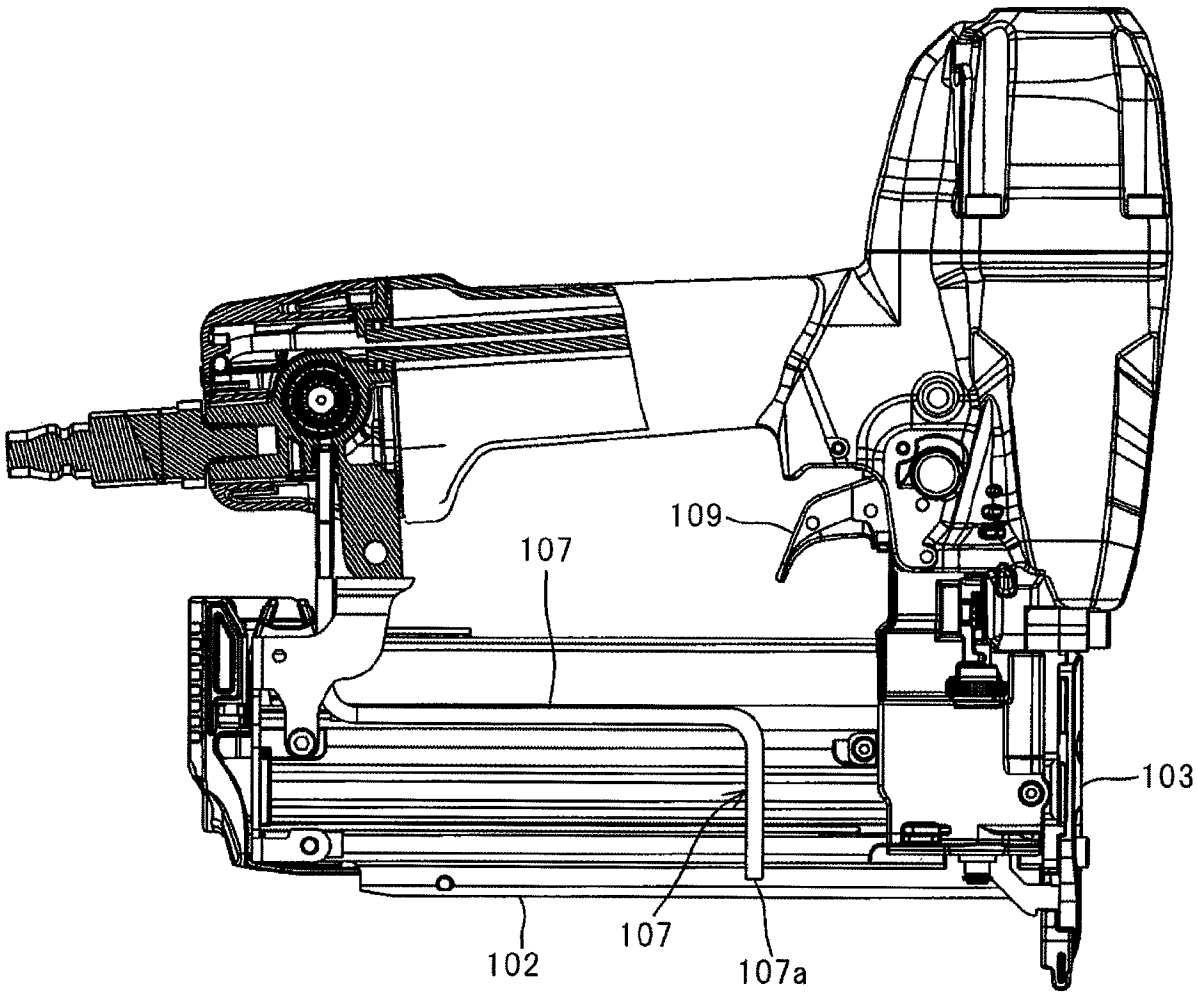
FIG. 21 is a side view of a nailing machine in still another embodiment showing a part of an air outlet in section.

Moreover, it would be sufficient that the air outlet 107*a* is positioned in vicinity of the nose part 103, and the air outlet 107*a* may be somewhat separated from the nose part 103, as shown in FIG. 20. It is also possible to form the air outlet 107*a* to be bent and suspended in front of the nose part 103, as shown in FIG. 21.

Figure 22A:
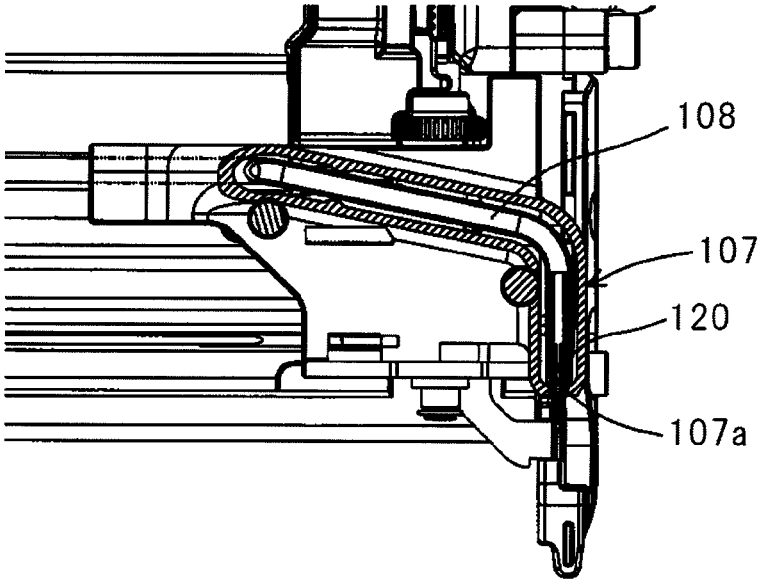
FIG. 22A is a sectional view showing an air jet nozzle provided in the air outlet in a state before blowing.
Figure 22B:
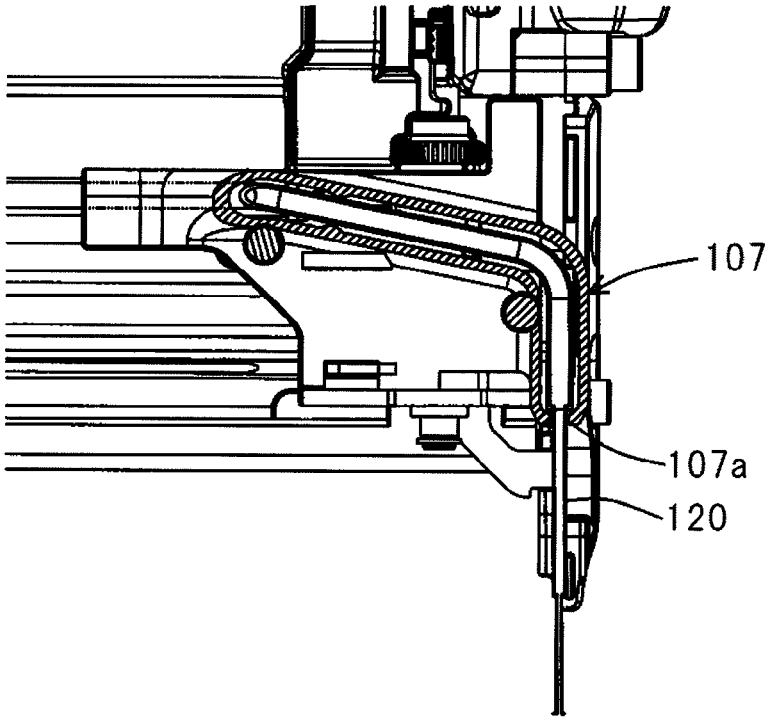
FIG. 22B is a sectional view showing an air jet nozzle provided in the air outlet in a state after the blowing.

Further, as shown in FIGS. 22A and 22B, a retractable air jet nozzle 120 may be formed inside the air outlet 107*a* so as to be pulled out or retracted. The air jet nozzle 120 may be retracted when the air duster 107 is not used, and may be pulled out for use to precisely blow out the compressed air to a target position.

Figure 23:
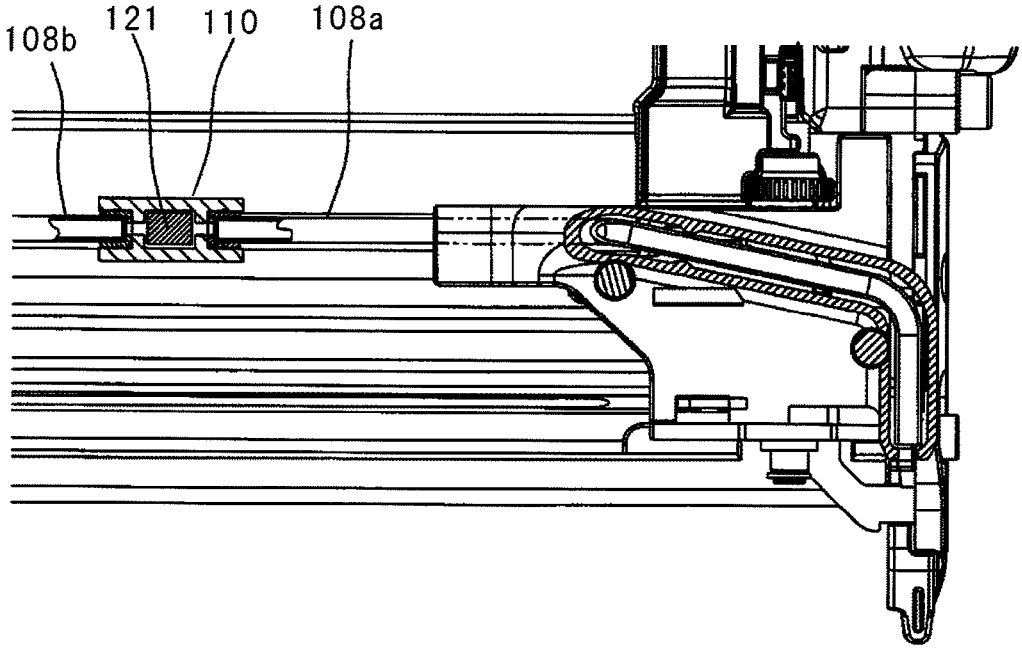
FIG. 23 is a sectional view showing an essential part of an air pipeline provided with a filter in still another embodiment.
Figure 24:
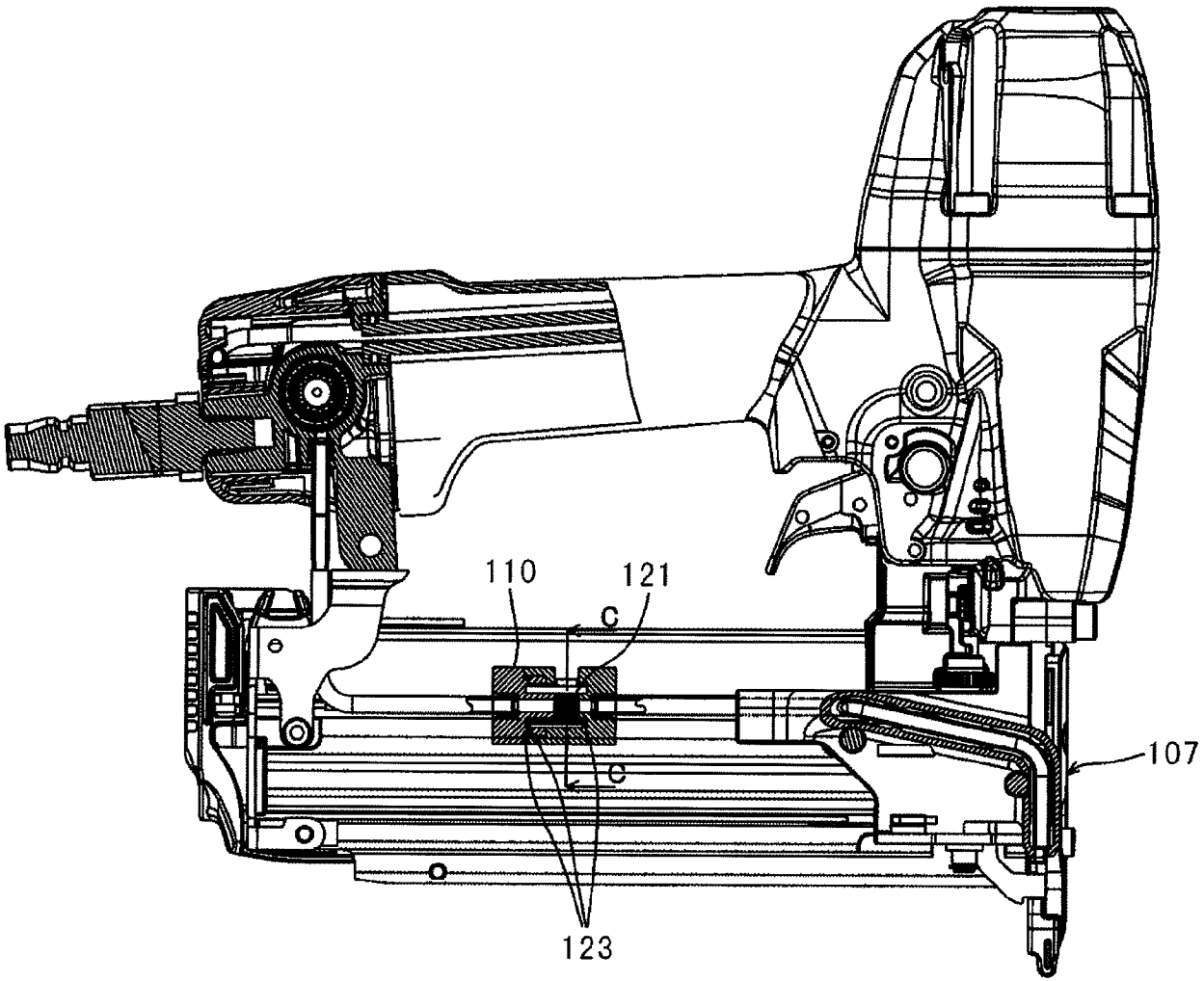
FIG. 24 is a sectional view showing an essential part of an air pipeline provided with a filter in still another embodiment.
Figure 25A:
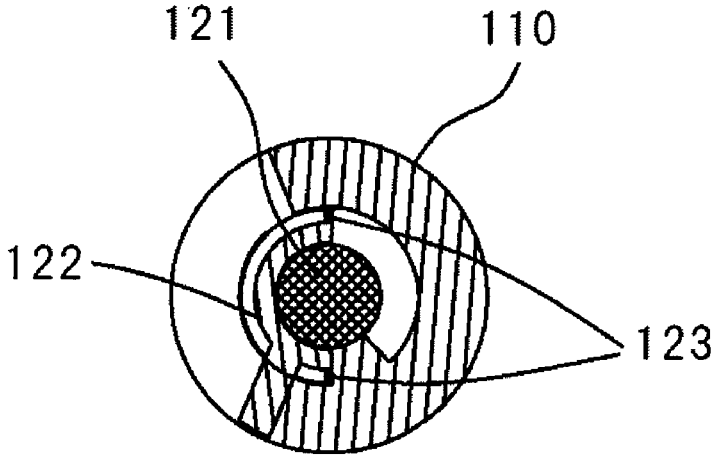
FIG. 25A is an enlarged sectional view taken along a line C-C in FIG. 24.
Figure 25B:
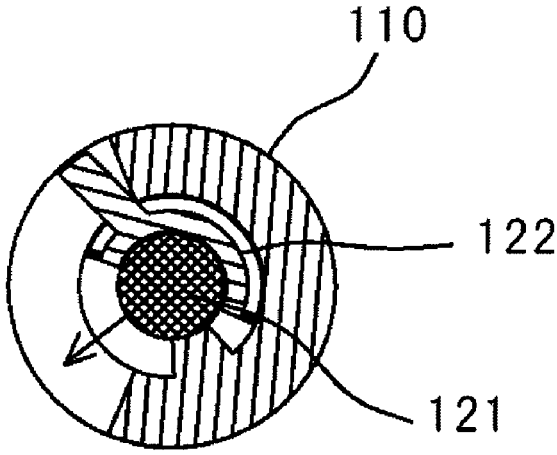
FIG. 25B is an enlarged sectional view taken along a line C-C in FIG. 24.

Further, connection between the front and rear air pipelines 108 is not limited to such in the above described embodiment. For example, a filter 121 may be disposed inside a connecting member 110, as shown in FIG. 23. In addition, as shown in FIGS. 24, 25A and 25B, the connecting member 110 may be so formed that its side part is opened or closed with a rotary door 122. The rotary door 122 is closed during ordinary operation, and by opening the rotary door 122, the filter 121 can be exchanged by taking it out from the connecting member. Denoted with reference numeral 123 is a seal member.

By thus providing the filter 121 in a halfway part of the air pipeline 108 so as to be exchanged, in case where oil or the like is mixed in the compressed air in the air pipeline 108, it is possible to remove mixed substance and to blow out dry air, and at the same time, it is possible to exchange the filter 121, when it is soiled.

Figure 26:
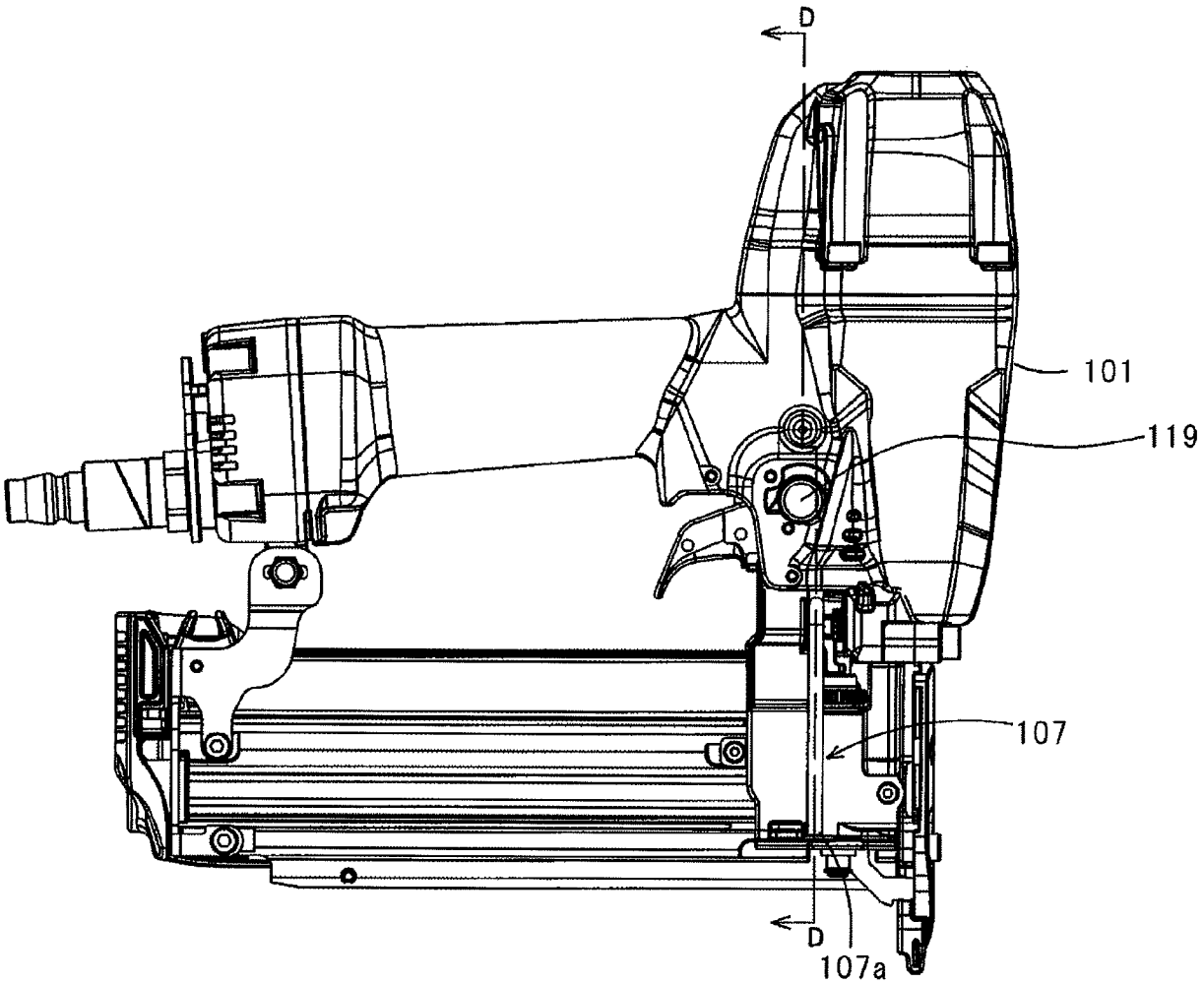
FIG. 26 is a side view of a nailing machine showing a mode in which an air pipeline is connected to an air chamber.
Figure 27A:
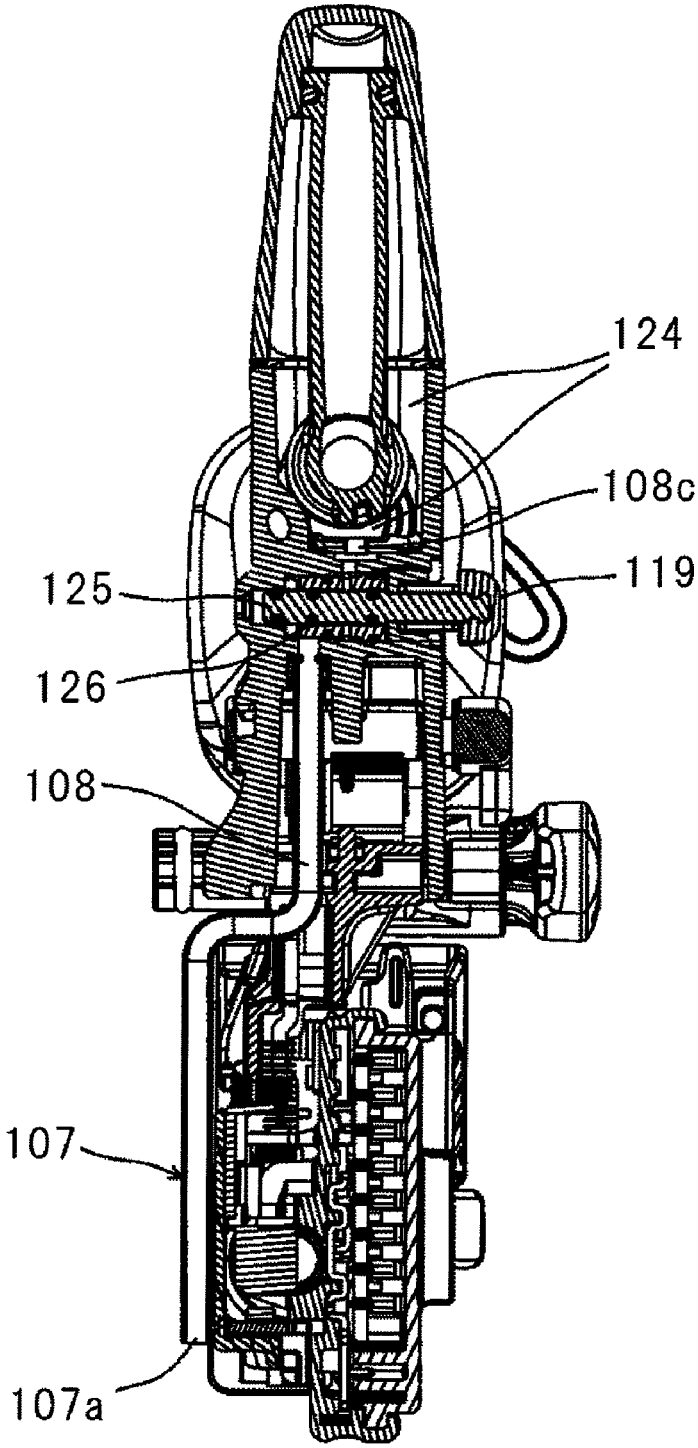
FIG. 27A is an enlarged sectional view taken along a line D-D in FIG. 26.
Figure 27B:
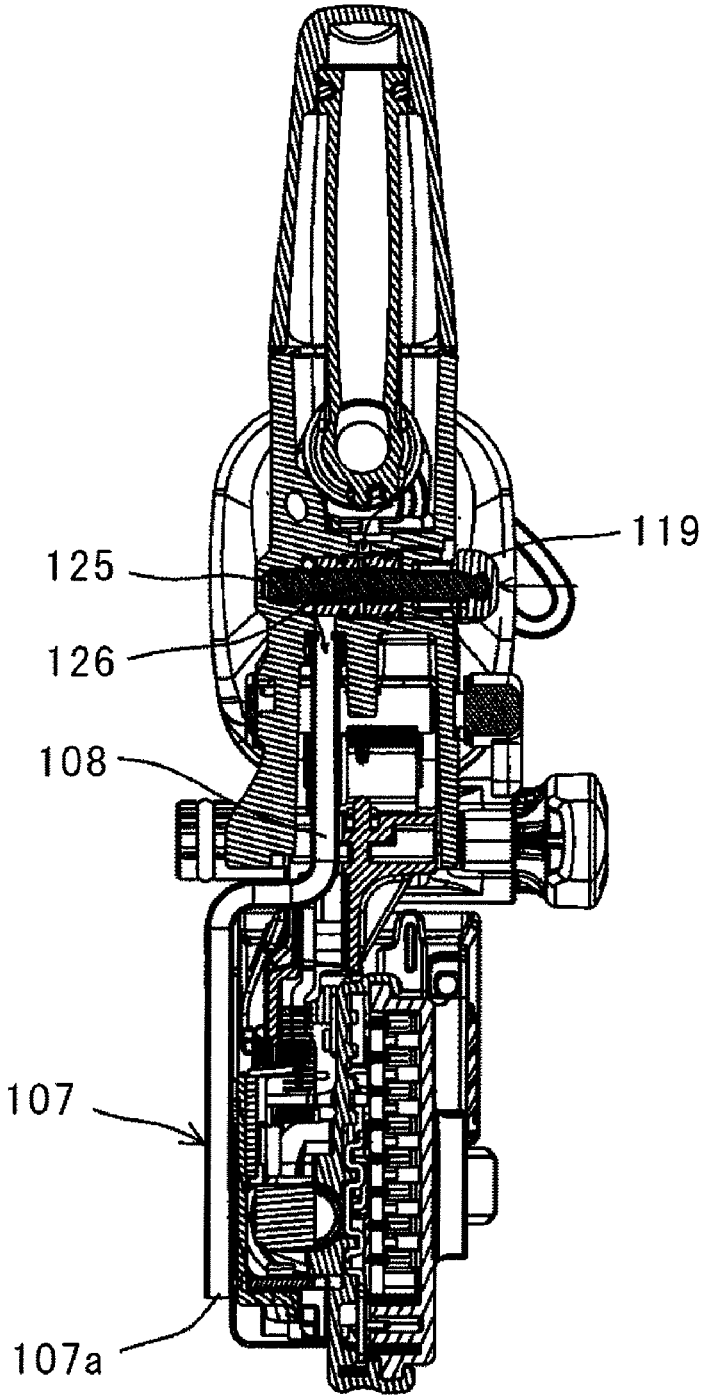
FIG. 27B is an enlarged sectional view taken along a line D-D in FIG. 26.

Still further, the air pipeline 108 is not necessarily branched from the aforesaid air supply pipe 106. As shown in FIGS. 26, 27A and 27B, the air pipeline 108 may be arranged in parallel with the tool body 101 having its one end 108*c* opened to the aforesaid air chamber (a part of the air chamber is denoted with 124), and connected to the air outlet 107*a* which is arranged near the nose part 103.

In this case, an opening and closing valve 125 (an air duster valve) for directly opening and closing the air pipeline 108 which interconnects the air chamber and the air outlet 107*a* of the air duster 107 may be actuated by operating the operating button 119, thereby to blow out the compressed air in the air chamber from the air outlet 107*a* of the air duster 107 according to necessity. Specifically, although in a state in FIG. 27A, the air pipeline 108 is closed with an O-ring 126 of the opening and closing valve, the O-ring 126 moves to a position for opening the air pipeline 108 by pressing the operating button 119, as shown in FIG. 27B. Accordingly, the compressed air in the air chamber is supplied to the air pipeline 108 to be blown out from the air outlet 107*a*.

Although the invention has been fully described referring to the specified embodiments, it would be apparent to those skilled in the art that various modifications and amendments can be added to the invention, without deviating from the sprit and scope of the invention.

The invention is based on Japanese Patent Application (Patent Application No. 2007-058761) filed on Mar. 8, 2007 and Japanese Patent Application (Patent Application No. 2007-148199) filed on Jun. 4, 2007, of which contents are hereby incorporated by reference.

The invention claimed is:

1. A pneumatic tool comprising:

a tool body, a nose part for ejecting a nail, which is provided in a lower part of said tool body, an air chamber for storing compressed air, which is provided in said tool body, an air supply pipe for supplying the compressed air from an air supply source to said air chamber, an air duster, an air duster pipeline connected to an air outlet of said air duster, and an air duster valve for diverting supply of the compressed air from the air supply pipe to said air duster pipeline without circulating the supply of compressed air to the air duster pipeline with the compressed air in the air chamber, wherein one end of said air duster pipeline is branched from said air supply pipe, while the other end of said air duster pipeline is connected to the air outlet of said air duster, and said air duster valve includes a selection operating device for selectively switching over the compressed air supplied from said air supply source to either said air outlet or said air chamber.

2. A pneumatic tool as claimed in claim 1, wherein one end of said air duster pipeline is connected to said air chamber, and said air duster valve includes an opening and closing valve for opening and closing said air duster pipeline.

3. A pneumatic tool as claimed in claim 1, wherein said air duster pipeline is arranged along a magazine.

4. A pneumatic tool as claimed in claim 1, wherein said air duster pipeline is arranged along said tool body.

5. A pneumatic tool as claimed in claim 1, wherein said air outlet is arranged in vicinity of said nose part, and the air is blown out from said air outlet along a direction of ejecting a fastener.

6. A pneumatic tool as claimed in claim 1, wherein said air duster pipeline is formed of metal.

7. A pneumatic tool as claimed in claim 1, wherein a filter is provided in a halfway part of said air duster pipeline so as to be exchanged.

8. A pneumatic tool as claimed in claim 1, wherein said air duster pipeline is arranged by way of a shock absorbing member.

9. A pneumatic tool as claimed in claim 8, wherein said shock absorbing member includes an O-ring.

10. A pneumatic tool as claimed in claim 1, wherein a flow controlling mechanism is provided in said air duster pipeline.

11. A pneumatic tool as claimed in claim 1, wherein a retractable air jet nozzle is provided inside said air outlet.

12. A pneumatic tool as claimed in claim 1, wherein an operating pipeline is branched from said air chamber, said air duster valve includes a selection valve which is provided in a branch part where said air duster pipeline is branched from said air supply pipe, said operating pipeline is connected to said selection valve by way of an opening and closing valve to be operated by an operating button, and said selection valve has a valve element which is movable between a first position where an upstream side pipeline leading to said air supply source is opened to a downstream side pipeline leading to said air chamber for storing the compressed air and shut off with respect to said air duster pipeline, and a second position where said upstream side pipeline leading to said air supply source is shut off with respect to said downstream side pipeline and opened to said air duster pipeline, wherein when said operating pipeline is closed by said operating button, said valve element is moved to the first position, and when said operating pipeline is opened by said operating button, said valve element is moved to the second position.

13. A pneumatic tool, comprising:

a tool body, a nose part for ejecting a nail, which is provided in a lower part of said tool body, an air chamber for storing compressed air, which is provided in said tool body, an air supply pipe for supplying the compressed air from an air supply source to said air chamber, an air duster, an air duster pipeline connected to an air outlet of said air duster, and an air duster valve for controlling supply of the compressed air to said air duster pipeline, wherein an operating pipeline is branched from said air chamber, one end of said air duster pipeline is branched from said air supply pipe, while the other end of said air duster pipeline is connected to the air outlet of said air duster, said air duster valve includes a selection valve which is provided in a branch part where said air duster pipeline is branched from said air supply pipe, said operating pipeline is connected to said selection valve by way of an opening and closing valve to be operated by an operating button, and said selection valve has a valve element which is movable between a first position where an upstream side pipeline leading to said air supply source is opened to a downstream side pipeline leading to said air chamber for storing the compressed air and shut off with respect to said air duster pipeline, and a second position where said upstream side pipeline leading to said air supply source is shut off with respect to said downstream side pipeline and opened to said air duster pipeline, wherein when said operating pipeline is closed by said operating button, said valve element is moved to the first position, and when said operating pipeline is opened by said operating button, said valve element is moved to the second position, and wherein the air outlet of said air duster is arranged in vicinity of said nose part, and a direction of blowing out the air from said air duster is substantially the same as a direction of ejecting a fastener by said tool body.

14. A pneumatic tool, comprising:

a tool body, a nose part for ejecting a nail, which is provided in a lower part of said tool body, an air chamber for storing compressed air, which is provided in said tool body, an air supply pipe for supplying the compressed air from an air supply source to said air chamber, an air duster, an air duster pipeline connected to an air outlet of said air duster, and an air duster valve for controlling supply of the compressed air to said air duster pipeline, wherein an operating pipeline is branched from said air chamber, one end of said air duster pipeline is branched from said air supply pipe, while the other end of said air duster pipeline is connected to the air outlet of said air duster, said air duster valve includes a selection valve which is provided in a branch part where said air duster pipeline is branched from said air supply pipe, said operating pipeline is connected to said selection valve by way of an opening and closing valve to be operated by an operating button, and said selection valve has a valve element which is movable between a first position where an upstream side pipeline leading to said air supply source is opened to a downstream side pipeline leading to said air chamber for storing the compressed air and shut off with respect to said air duster pipeline, and a second position where said upstream side pipeline leading to said air supply source is shut off with respect to said downstream side pipeline and opened to said air duster pipeline, wherein when said operating pipeline is closed by said operating button, said valve element is moved to the first position, and when said operating pipeline is opened by said operating button, said valve element is moved to the second position, and wherein said operating button is disposed on a side face of said tool body, within a reach of a thumb or an index finger of a worker who has gripped said tool body.

* * * * *